US007837609B2

(12) United States Patent
Meriño et al.

(10) Patent No.: US 7,837,609 B2
(45) Date of Patent: Nov. 23, 2010

(54) CENTRIFUGE WITH REMOVABLE CORE FOR SCALABLE CENTRIFUGATION

(75) Inventors: Sandra Patricia Meriño, Vianan (NL); Steven J. Dalessio, Hopatcong, NJ (US); Robin Roy Louis Rudy Otten, Montfoort (NL)

(73) Assignee: Alfa Wassermann, Inc., West Caldwell, NJ (US)

( * ) Notice: Subject to any disclaimer, the term of this patent is extended or adjusted under 35 U.S.C. 154(b) by 60 days.

(21) Appl. No.: 10/497,417

(22) PCT Filed: Nov. 25, 2002

(86) PCT No.: PCT/US02/37849

§ 371 (c)(1),
(2), (4) Date: Apr. 22, 2005

(87) PCT Pub. No.: WO03/045568

PCT Pub. Date: Jun. 5, 2003

(65) Prior Publication Data

US 2005/0176571 A1 Aug. 11, 2005
US 2010/0041536 A9 Feb. 18, 2010

Related U.S. Application Data

(63) Continuation of application No. 09/995,054, filed on Nov. 27, 2001, now abandoned.

(51) Int. Cl.
*B04B 1/04* (2006.01)

(52) U.S. Cl. ..... 494/60; 494/65; 494/67; 494/74

(58) Field of Classification Search ..... 494/37, 494/65, 67, 74, 79, 60
See application file for complete search history.

(56) References Cited

U.S. PATENT DOCUMENTS 3,073,517 A 1/1963 Pickels et al.

(Continued)

FOREIGN PATENT DOCUMENTS

EP 0257755 A1 3/1988

OTHER PUBLICATIONS

Fishbane et al., "Physics for Scientists and Engineers", 1993, Prentice-Hall, Inc., pp. A-5 and A-6.*

(Continued)

*Primary Examiner*—David L Sorkin
(74) *Attorney, Agent, or Firm*—Ohlandt, Greeley, Ruggiero & Perle, LLP

(57) ABSTRACT

The present invention relates to a centrifuge apparatus. The centrifuge apparatus is operable at certain predetermined parameters depending upon a product to be separated and is useable with a plurality of rotor assemblies. For example, a first rotor assembly of said plurality of rotor assemblies includes a first core having a first core configuration which is contained within a rotor housing of the first rotor assembly to define a first volume capacity such that the product passing through the first rotor assembly having the first volume capacity during rotation of the first rotor assembly in the centrifuge apparatus achieves a first particle separation of the product. A second rotor assembly of said plurality of rotor assemblies includes a second core having a second core configuration which is contained with a rotor housing of the second rotor assembly to define a second volume capacity of such that product passing through the second rotor assembly having the second volume capacity during rotation of the second rotor assembly in the centrifuge apparatus achieves a second particle separation of the product. It is observed that the second particle separation is a linear change with respect to the first particle separation.

6 Claims, 16 Drawing Sheets

U.S. PATENT DOCUMENTS

| | | | | | |
|---|---|---|---|---|---|
| 3,288,360 | A | * | 11/1966 | Babelay et al. | 494/67 |
| 3,430,849 | A | | 3/1969 | Gibson et al. | |
| 3,536,253 | A | * | 10/1970 | Anderson et al. | 494/27 |
| 3,708,111 | A | | 1/1973 | Sheeler et al. | |
| 3,730,422 | A | | 5/1973 | Cho | |
| 3,899,128 | A | | 8/1975 | Joyce | |

OTHER PUBLICATIONS

Anderson, Norman G., editor, "National Cancer Insitite Monograph 21: The Development of Zonal Centrifuges and Ancillary Systems for Tissue Fractionation and Analysis", Jun. 1966, pp. 137-143, 160, 191 and 192.*

Cline, George B. "Continuous Sample Flow Density Gradient Centrifugation", 1971, In Perry and VanOss (editors) Progress in Separation and Purification, John Wiley and Sons, Inc., New York, pp. 297-324.*

Anderson et al., "K-series centrifuges: I. Development of the K-II Continuous-Sample-Flow-with-Banding Centrifuge System for Vaccine Purification", 1969, Analytical Biochemistry vol. 32, pp. 460-494.*

Anderson, N.G. "Preparative Zonal Centrifugation" Methods of Biochemical Analysis vol. XV, 1967, pp. 271-311.

Written Opinion dated Mar. 16, 2009 for corresponding Singapore Application No. 200506506-5.

N.G. Anderson, "Preparative Zonal Centrifugation", Methods of Biochemical Analysis, vol. XV, pp. 271-310, 1967.

Supplementary European Search Report dated Oct. 26, 2009 for European application No. EP 02 79 7148.

Office Communication dated Apr. 16, 2010 in Canadian Patent Application No. 2,468,337.

* cited by examiner

CENTRIFUGE WITH REMOVABLE CORE FOR SCALABLE CENTRIFUGATION

CROSS-REFERENCE TO RELATED APPLICATIONS

This application is a U.S. National Stage entry under 35 U.S.C. §371 of PCT/US02/37849, filed Nov. 25, 2002. PCT/US02/37849 is a continuation of U.S. Ser. No. 09/995,054, filed on Nov. 27, 2001, now abandoned.

FIELD OF THE INVENTION

The present invention is directed to centrifuge equipment utilizing a removable core which can be replaced with another core of different dimensions to obtain directly linear scale process results for a particulate protein separation and purification protocol. More particularly, the invention provides a centrifuge rotor assembly comprising means for adjusting the volume of the rotor assembly to accommodate, for example, large-scale, pilot-scale and laboratory-scale centrifugation needs.

Documents cited herein in the following text are incorporated by reference.

BACKGROUND OF THE INVENTION

In the biological and chemical sciences, there is often a need to separate particulate matter suspended in a solution. In a biological experiment, for example, the particles typically are cells, subcellular organelles and macromolecules, such as DNA fragments. A centrifuge is routinely used to perform the separation of these components from a solution.

The types of experiments that can be performed with a centrifuge are based primarily on three major sedimentation (fractionation) protocols, namely, differential pelleting sedimentation (differential centrifugation), rate-zonal density-gradient sedimentation and isopycnic density-gradient sedimentation.

Basically, a centrifuge creates a centrifugal force field by spinning a solution containing suspended particles to be separated, thus causing the suspended particles to separate from the solution. The sedimentation rate of a particle is a function of such factors as the molecular weight and density of the particle, the centrifugal field acting upon the particle, and the viscosity and density of the solution in which the particle is suspended.

A differential pelleting experiment is primarily used for the sedimentation of particles according to size. The material to be fractionated is initially distributed uniformly throughout the sample solution. A centrifuge tube filled with the sample solution is spun to produce a centrifugal field which acts on the particles in the sample solution. Eventually, a pellet is formed at the bottom of the tube which is composed primarily of the larger particles present in the solution, but also includes a mixture of other smaller particles suspended in the solution.

A rate-zonal separation protocol is used to improve the efficiency of the fractionation by separating the particles according to size. Rate-zonal sedimentation of particles relies on the property that particles of different sizes (and therefore different masses) will migrate through a density-gradient at different rates when subjected to a centrifugal force. The technique involves layering a sample containing the components of interest onto the top of a liquid column which is stabilized by a density-gradient of an inert solute, such as sucrose. The maximum density of the gradient typically is less than the buoyant density of the components of interest, to allow migration of the components along the gradient. Upon centrifugation, the particles are driven down the gradient at a rate dependent upon factors including the mass and density of each particle, the density of the gradient, and the centrifugal forces acting upon each particle. Generally, the more massive particles will migrate at a faster rate than the lighter particles. With the passage of time, numerous "zones" or "bands" of particles having similar mass will form. As the centrifugation continues, the widths of the zones measured along the central axis of the centrifuge tube increase as well as the separation between bands. In addition, the zones themselves migrate toward the bottom of the tube, and eventually will coalesce at the bottom.

The third type of fractionation is another type of zonal separation called isopycnic density-gradient sedimentation, which relies on differences in the buoyant properties of the constituent particles dispersed in a high density solution as the basis for separation of the constituents. While centrifugation must proceed for a period of time sufficient to allow for banding, the protocol is an equilibrium technique in which separation essentially is independent of the time of centrifugation and of the size and shape of the constituents, although these parameters do determine the rate at which equilibrium is reached and the width of the zones formed at equilibrium.

There are two ways to prepare a solution for isopycnic separation. A solute having a pre-formed high density-gradient is provided, in which a sample containing the macromolecules is included. Subsequent centrifugation of the preparation will cause the macromolecules of the sample to migrate through the high density solute, forming bands at positions along the density-gradient corresponding to the buoyant density of each macromolecule. At each of these equilibrium positions, the buoyant force of the solute acting on a macromolecule is canceled by the opposing forces of the centrifugal field. Alternatively, the solution to be centrifuged may be prepared by mixing a solution of the macromolecules or particles of interest with a high density solute to give a uniform solution of both. In this case, the density-gradient forms during the centrifugation, with the particles forming bands along the resulting gradient as described.

Present centrifuge systems provide users with an interface for selecting the speed and duration of a centrifuge run. Additional parameters may be set, including a temperature setting for the run and the particular rotor to be used. Typically, a user will set up a centrifuge run first by deciding which of the three types of centrifuge protocols is appropriate. Next, the user must determine the centrifugation speed and the run-time and then set the centrifuge accordingly. Computing the run-speed and the run-time depends upon a number of factors, such as the selected centrifuge protocol, the sedimentation rate of the particles and knowledge of the parameters of the rotor to be used. In the case of density-gradient separations, namely, the rate-zonal and isopycnic protocols, the gradient of the solute must be included in the computations as well. However, present centrifuges are not configured to be scalable. In other words, users cannot utilize the same centrifuge system to accommodate the varying volumetric sizes required for laboratory scale, pilot-scale and large scale needs.

Centrifugation separations are based on particle movement in an applied centrifugal field and the parameters of density, molecular weight and shape will affect this separation. For instance, classification of centrifugation techniques has split the field into preparative and analytical methods for the range of sub-cellular particles, single cell organisms, viruses, and macromolecules.

Analytical centrifugation has been used to obtain information regarding molecular structure, interactions of molecules, and to give an initial estimation of molecular types in a new preparation. Preparative centrifugation utilizes the same separation principles of analytical centrifugation to achieve a bulk manufacture of biological materials for use in parenteral or diagnostic processes.

Zonal rotor assemblies have been used for many years and considerable literature is available on the subject. Information about zonal rotors is included in most purification handbooks and biochemistry texts. Specific information can be found in Anderson, *An Introduction to Particle Separations in Zonal Centrifuges* (National Cancer Institute Monograph No. 21, 1966); Anderson, *Separation of Sub-Cellular Components and Viruses by Combined Rate and Isopycnic Zonal Centrifugation* (National Cancer Institute Monograph No. 21, 1966); and, Anderson, *Preparative Zonal Centrifugation*, in *Methods of Biochemical Analysis* (1967), all of which are incorporated herein by reference.

Typically, the zonal rotor assembly has an outer cylinder for containing the product and the outer cylinder is subdivided with unitarily formed interceptive cross-bars (sometimes referred to as fins or vanes) which extend and are attached to the bowl and are not exposed therefrom.

The zonal rotor assembly is made, for example, of titanium and as aforementioned in a one piece construction of the outer cylinder and cross bars with a lid, which provides the strength needed to withstand the high gravitational forces necessary for the ultracentrifugation up to 150,000×g. Two general formats of zonal rotors were developed, commonly known in the art as the bowl type and the tubular type rotor assemblies.

The bowl type rotor assembly, for example, the Ti-15 (Beckman Coulter Inc.), is a wide squat bowl-shaped rotor assembly and can typically be used to 90,000×g in a batch mode operation. The same type of rotor was manufactured by Beckman Coulter to enable continuous flow operation.

Tubular assembly rotors were developed by Electro-Nucleonics (now AWI) and Hitachi Koki Co. (distributed by Kendro) and are long and tubular in shape and generate gravitational force up to 121,000×g. A centrifuge incorporating a tubular rotor assembly is described by Hsu, *Separation and Purification Methods,* 5(1), 51-95 (1976), which is incorporated herein by reference.

Density gradient ultra-centrifugation using a zonal rotor assembly as a preparative methodology has been used widely to fractionate different substances or materials, included but not limited to animal, plant and bacterial cells, viral particles, lysosomes, membranes and macromolecules in a variety of processes. As an example, its application is of particular significance in the commercial preparation of viruses for vaccine and immuno-therapy products in both batch and continuous flow zonal modes. These methods are traditionally used to purify influenza virus for vaccines. In addition, many other uses for the zonal centrifuge tubular or batch types have been documented, see Cline, *Progress in Separation and Purification* (1971), which is incorporated herein by reference.

Although the small scale tubular rotor assemblies in the art provide an adequate separation, they are not suited for linear scale separations because of, for example, differences in path length and wall affects (see Rickwood, *Preparative Centrifugation: A Practical Approach,* 1992, incorporated herein by reference).

Density gradient ultra-centrifugation, a type of zonal separation, enables sufficient and rapid purification of macromolecules for initial protein characterization studies without the requirement of a lengthy process of development and optimization of a chromatography technique. Furthermore, density gradient ultra-centrifugation remains a preferred cost-effective route for the commercial separation of large particulate viruses and vaccines.

Most zonal separation is undertaken using density gradients which are loaded into the rotor assembly prior to loading the fluid containing the particle product. Particle separation occurs in the gradient of increasing density. The particles eventually band isopycnically in the zones where the gradient density equals the particles' buoyant density.

A disadvantage of current zonal separation centrifuge systems is that they are not linearly scalable. In other words, a user cannot scale up or down, for separations of different volumes or quantities, e.g., from laboratory scale to pilot scale to industrial scale or from industrial scale pilot scales to laboratory scale, using the same centrifugation system.

A need exists in the art, therefore, to use the same centrifuge system for sedimentation processes of different volumes or quantities e.g., large-scale, pilot-scale and laboratory-scale processes. In the known art, if a centrifuge system was used in a laboratory scale process, it could not be used in a pilot or large scale process. Each process required different centrifuge machinery. Each case also required the determination of new process parameters in order to achieve the same separation characteristics. In contrast to the prior art, the present invention provides a method and apparatus for adjusting the volume of the rotor assembly so the same centrifuge systems can be used for sedimentation processes of multiple scales while maintaining substantially the same separation characteristics for each process. In a preferred embodiment, the volume of the rotor assembly is adjusted by interchanging different sized and configured core assemblies within the outer cylindrical rotor housing, thus affording a considerable improvement to the current range of centrifugation products.

OBJECTS OF THE INVENTION

Therefore, it is an object of the invention to provide an improved centrifuge apparatus and process which avoids the aforementioned deficiencies of the prior art.

It is an object of the invention to provide a centrifuge apparatus and process in which the volume of the product sample centrifuged can be scaled up or down while maintaining substantially the same selected separation parameters of the process.

It is an object of the invention to provide a centrifuge apparatus and process in which the volumetric capacity of the rotor assembly of the centrifuge can be varied or changed to accommodate different volumes of product sample to be centrifuged.

It is another objective of the invention to provide replaceable cores of different sizes which can be utilized in the same centrifuge apparatus to change the volumetric capacity of the rotor assembly to allow scale ups or scale downs of product sample to be centrifuged without substantially altering selected separation parameters such as sedimentation path, residence path and flow dynamics.

Various other objects, advantages and features of the present invention will become readily apparent from the ensuing detailed description and the novel features will be particularly pointed out in the appended claims.

SUMMARY OF THE INVENTION

In accordance with one embodiment of the present invention, a centrifuge apparatus is operable at certain predetermined parameters depending upon a product to be separated and is useable with a plurality of rotor assemblies wherein a first rotor assembly of said plurality of rotor assemblies includes a first core having a first core configuration which is contained within a rotor housing of the first rotor assembly to define a first volume capacity such that the product passing through the first rotor assembly having the first volume capacity during rotation of the first rotor assembly in the centrifuge apparatus achieves a first particle separation of the product, and a second rotor assembly of said plurality of rotor assemblies includes a second core having a second core configuration which is contained with a rotor housing of the second rotor assembly to define a second volume capacity such that product passing through the second rotor assembly having the second volume capacity during rotation of the second rotor assembly in the centrifuge apparatus achieves a second particle separation of the product which is a linear change with respect to the first particle separation.

In accordance with a further embodiment of the present invention, a centrifuge system includes a rotor assembly which contains the product sample that is to be centrifuged. The rotor assembly includes an outer rotor housing and a core which freely rotates to create the centrifugal force that separates the desired particles from the product sample. The rotor assembly capacity is essentially the capacity of the rotor assembly with the core installed in the rotor housing. In the invention, the rotor assembly capacity is variable to accommodate correspondingly different volumes of product sample without substantially changing selected separation parameters, such as a rotational speed and gravitational force, as the rotor assembly capacity is varied.

In accordance with yet another embodiment, a centrifuge apparatus is operable at certain predetermined parameters depending upon a product to be separated and is usable with a plurality of rotor assemblies wherein a first rotor assembly of said plurality of rotor assemblies has a first residence length such that the product passing through the first rotor assembly during rotation thereof in the centrifuge apparatus achieves a first particle separation of the product and a second rotor assembly of said plurality of rotor assemblies has a second residence length such that the product passing through the second rotor assembly during rotation thereof in the centrifuge apparatus achieves a second particle separation of the product which is a linear change with respect to the first particle separation.

In accordance with still another embodiment, the rotor assembly capacity is changed by providing more than one core for the rotor assembly. Each core has a different configuration from the other core(s). The use of one core in the rotor assembly will result in a rotor assembly capacity which is different from the rotor assembly capacity when another core is utilized. In one aspect of the invention, the different sized or configured cores can be used to allow the user to operate the centrifuge in different volumes of product samples. In a further aspect of the invention, the cores can be configured so that use of the different cores not only changes the capacity of the rotor assembly but also substantially maintains selected separation parameters in the centrifuge process.

In accordance with a further embodiment, the rotor assembly includes an outer rotor housing which is formed as a hollow cylinder with threaded end caps to form the outer body of the rotor assembly. An inner core is adapted to be contained within the outer body so as to create a flow path of particles within the rotor assembly. The inner core includes tubular channels for fluid flow and a plurality of fins extend radially from the center core and prevent mixing of the particles during use. As will be explained in more detail below, the size and configuration of the inner core and the fins integrally formed thereto can be altered to change the volume and hence the capacity of the rotor assembly. Moreover, the residence capacity of the rotor assembly can be changed so as to provide linear separation of the particles within the rotor assembly.

The present invention further provides a method for rapidly changing the volume capacity during centrifugation but maintains performance parameters, such as the rotational speed and gravitational force of the rotor assembly, irrespective of the volume capacity of the rotor assembly. The method includes the steps of operating a centrifuge apparatus at certain predetermined parameters depending upon a product to be separated, rotating a first rotor assembly having a first residence length in the centrifuge apparatus, passing the product through the first rotor assembly during rotation thereof to achieve a first particle separation of the product, substituting the first rotor assembly in the centrifuge apparatus with a second rotor assembly having a second residence length and rotating the second rotor assembly within the centrifuge apparatus, passing the product through the second rotor assembly during rotation thereof to achieve a second particle separation of the product which is linear with respect to the first particle separation.

In another aspect of the present invention, the method includes the steps of operating a centrifuge apparatus at certain predetermined parameters depending upon a product to be separated, placing a first core having a first core configuration in a rotor housing to define a first rotor assembly having a first volume capacity, rotating the first rotor assembly having first volume capacity in the centrifuge apparatus so as to achieve a first particle separation of the product, substituting a second core having a second core configuration within the rotor housing to define a second rotor assembly having a second volume capacity, rotating the second rotor assembly having the second volume capacity in the centrifuge apparatus so as to achieve a second particle separation of the product which is linear with respect to the first particle separation. In this aspect of the invention, the volume capacity of the rotor assembly can be changed by varying the size, cross section and number of rotor fins which extend radially outwardly from and are integrally formed with the core.

Therefore, the present invention provides a centrifuge apparatus and process in which the volumetric capacity of the rotor assembly can be varied or changed to accommodate different volumes of product sample to be centrifuged. In addition, the present invention provides for replaceable cores with different fin configurations which can be used in the same centrifuge apparatus to change the volumetric capacity of the rotor assembly to allow scale up or scale down of the product sample to be centrifuged without substantially altering selected separation parameters.

These and other embodiments of the invention are provided in or are obvious from the following detailed description of the invention.

BRIEF DESCRIPTION OF THE DRAWINGS

The following detailed description given by way of example, but not intended to limit the invention solely to the specific embodiments described, may best be understood in conjunction with the accompanying drawings in which.

DETAILED DESCRIPTION OF CERTAIN PREFERRED EMBODIMENTS

Figure 1:
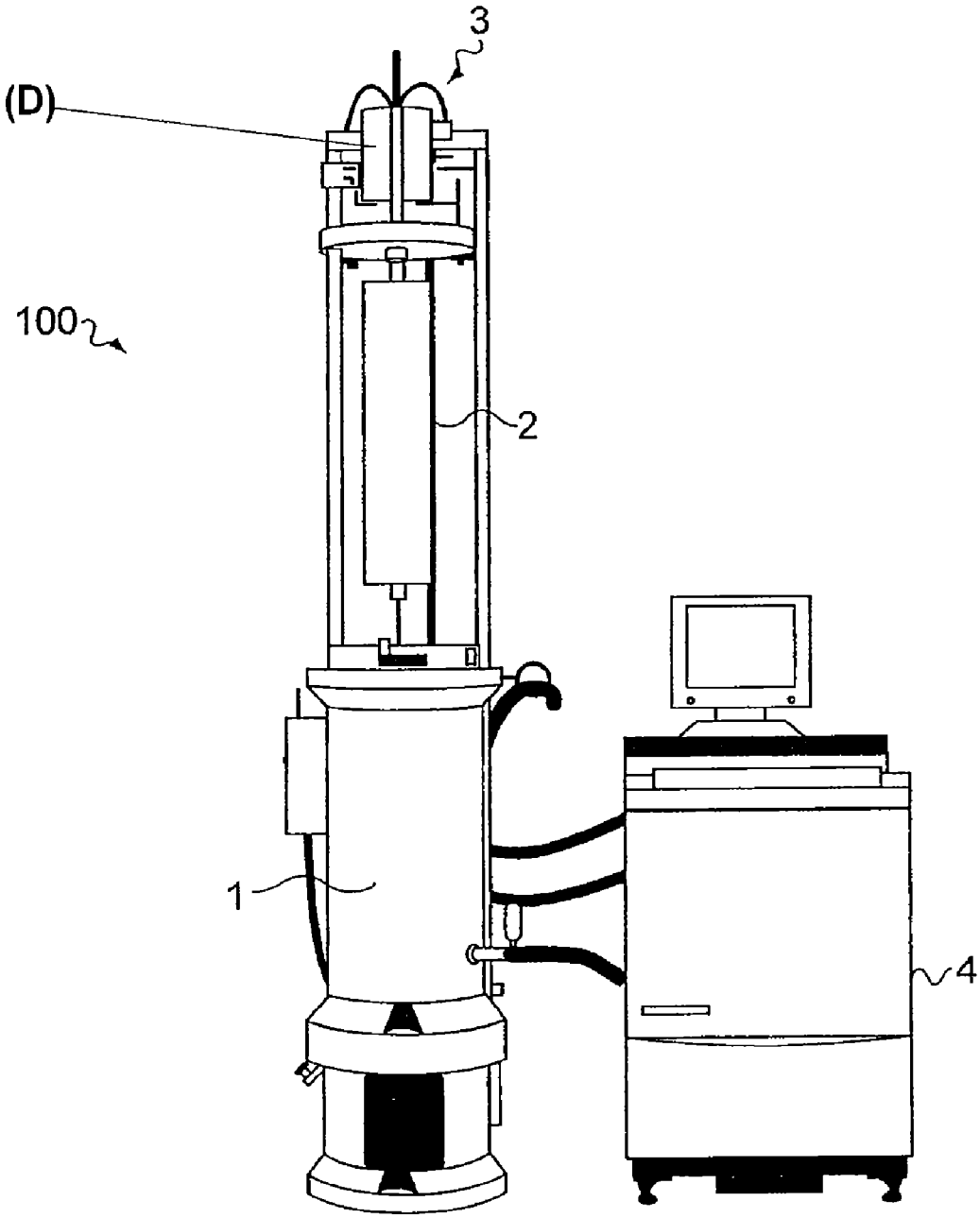
FIG. 1 is a front elevational view of a centrifuge apparatus including a preferred embodiment of a centrifuge rotor assembly in accordance with the teachings of the present invention.

The embodiments of the present invention can be used to perform separations and, more particularly, separations of liquid, fluid and/or particulate matter. The separation techniques include but are not limited to density gradients on a continuous or batch basis, pelleting, rate zonal separations and gradient resolubilization.

The present invention provides for a centrifuge rotor assembly comprising means for adjusting the volume of the rotor assembly to accommodate, for example, large-scale, pilot scale and laboratory scale separations. The separations utilizing the present invention are both scalable and linear. Scalability is the ability to go from one volume of product to another volume of product without significant changes to the centrifuge protocol. Linearity is the ability for the centrifuge to separate different density materials to yield the same purification results and/or concentration. The present invention provides, therefore, a centrifuge apparatus and process in which the volume of the product sample centrifuged can be scaled up or down while maintaining substantially the same selected separation parameters of the process; a centrifuge apparatus and process in which the volumetric capacity of the rotor assembly of the centrifuge can be varied or changed to accommodate different volumes of product sample to be centrifuged; and replaceable cores of different sizes which can be utilized in the same centrifuge apparatus to change the volumetric capacity of the rotor assembly to allow scale ups or scale downs of product sample to be centrifuged without substantially altering selected separation parameters such as sedimentation path, residence path and flow dynamics. As will be seen in the Examples that follow, formation of equivalent gradients among the large-scale and pilot scale rotor assemblies; equivalent product separation at the iso-dense layer in each scale of rotor assembly; and equivalent product peak shape in the gradient for each scale rotor assembly indicate that scalability and linearity are achieved.

Specifically, the present invention is directed to a centrifuge apparatus that is operable at certain predetermined parameters depending upon a product to be separated. The centrifuge apparatus is useable with a plurality of rotor assemblies. For example, a first rotor assembly of said plurality of rotor assemblies may include a first core having a first core configuration which is contained within a rotor housing of the first rotor assembly. The first core defines a first volume capacity. Thus, when a product passes through the first rotor assembly having the first volume capacity during rotation of the first rotor assembly in the centrifuge apparatus, a first particle separation of the product is achieved. A second rotor assembly of said plurality of rotor assemblies includes a second core having a second core configuration which is contained with a rotor housing of the second rotor assembly to define a second volume capacity. Thus, a product passing through the second rotor assembly having the second volume capacity during rotation of the second rotor assembly in the centrifuge apparatus achieves a second particle separation of the product. The second particle separation is linear with respect to the first particle separation.

In a preferred embodiment, the present invention contemplates that the rotor housing of the first and the second rotor assemblies to be the same. In other words, the rotor housing has the same residence length.

Further, the centrifuge apparatus of the present invention is operable at certain predetermined parameters and is usable with a plurality of rotor assemblies, wherein a first rotor assembly of said plurality of rotor assemblies has a first residence length such that the product passing through the first rotor assembly during rotation thereof in the centrifuge apparatus achieves a first particle separation of the product. A second rotor assembly of said plurality of rotor assemblies has a second residence length such that the product passing through the second rotor assembly during rotation thereof in the centrifuge apparatus achieves a second particle separation of the product. The second particle separation is linear with respect to the first particle separation.

The present invention also contemplates a method for achieving linear scale separation of particles of a product during centrifugation. A centrifuge apparatus is operated at certain predetermined parameters depending upon a product to be separated. A first core having a first core configuration is placed in a rotor housing to define a first rotor assembly having a first volume capacity. The first rotor assembly having the first volume capacity in the centrifuge apparatus is rotated, whereby the product is passed through the first rotor assembly during rotation. This first rotation achieves a first particle separation of the product. A second core having a second core configuration is substituted for the first core within the rotor housing to define a second rotor assembly having a second volume capacity. This second rotor assembly is rotated, during which the product is passed through the second rotor assembly during rotation thereof, thereby achieving a second particle separation of the product. This second particle separation is a linear change with respect to the first particle separation.

A method for achieving a linear scale separation is also provided by the present invention. A centrifuge apparatus at certain predetermined parameters depending upon a product to be separated is operated. A first rotor assembly having a first residence length in the centrifuge apparatus is rotated, whereby the product passing through the first rotor assembly during rotation achieves a first particle separation of the product. After the first particle separation, a second rotor assembly is substituted for the first rotor assembly. The second rotor assembly has a second residence length and the second rotor assembly is rotated within the centrifuge apparatus. During rotation, the product passes through the second rotor assembly to achieve a second particle separation of the product, the second particle separation being linear with respect to the first particle separation.

The centrifuge apparatus of the present invention also comprises means for setting a number of parameters for the centrifugation. Adjustment means are also provided for setting parameters and having one of a rotor assembly selected from among a plurality of rotor assemblies so as to enable volume capacity to be adjusted. The adjustment means enables, for example, substitution of a rotor core of varying configurations within each of said plurality of rotor assemblies.

The present invention further contemplates a rotor assembly rotatable in a centrifuge assembly for separating particles of a product passing therethrough. The rotor assembly is provided with a rotor housing of a defined volume and a rotor core freely rotatable within the rotor housing. The rotor core includes a plurality of product flow distribution channels and a plurality of fins extending radially therefrom of a predetermined configuration to define a volume of the predetermined rotor core.

A rotor core for a rotor assembly rotatable in a centrifuge assembly for separating particles of a product passing through the rotor assembly is also provided by the present invention. It is envisioned that the rotor core includes a plurality of product flow distribution channels and a plurality of fins extending radially therefrom of a predetermined configuration to define a predetermined volume of the rotor core.

Each rotor core of the plurality of rotor assemblies, as contemplated by the present invention, includes a plurality of fins arranged in a predetermined manner. These fins are equidistantly spaced apart from each other and extend radially outward from the rotor core. The number of fins contemplated to be placed on each core number from between 0 to 36, preferably from between 0 to 6. Each rotor core also includes a plurality of product flow distribution channels.

I. Description of Centrifuge Apparatus and Basic Components

Reference is now made to the figures wherein like parts are referred to by like numerals throughout. FIG. 1 depicts centrifuge 100 according to the present invention. Centrifuge 100 of the present invention may be utilized in a process for separating components of a product sample in which the volume of the product sample can be scaled up or down while maintaining substantially the same selected separation parameters of the process.

With particular reference to FIG. 1, centrifuge 100 includes a tank assembly 1 within which is housed a drive turbine and a rotor assembly 2. Drive turbine D is used to spin rotor assembly 2 at high speeds. As will be described in further detail below with respect to FIG. 2*a*, the rotor assembly 2 typically includes an outer rotor housing 5, two end caps 7, 8 and a core 6. A lift assembly 3 is provided to raise both drive turbine D and the rotor assembly 2 from tank assembly 1 as shown in FIG. 1. A console assembly 4 is provided which connects to tank assembly 1 and controls the critical functions of centrifuge 100 such as, for example, time and speed.

II. Description of Rotor Assembly

Figure 2A:
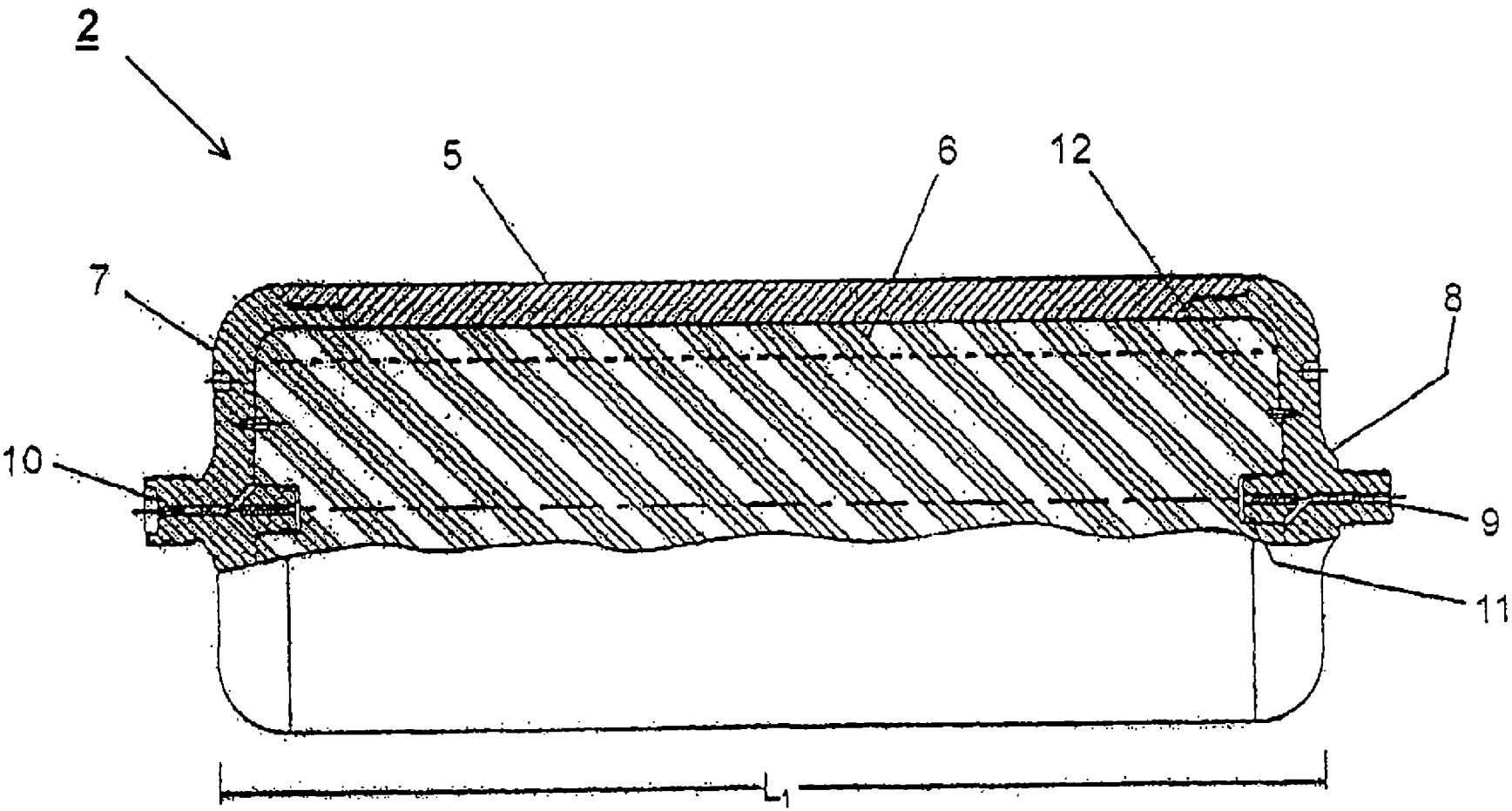
FIG. 2*a* is a front cross-sectional view of a preferred embodiment of a rotor assembly to be rotated in the centrifuge apparatus of FIG. 1.

With reference to FIG. 2*a*, useful for large scale separations and adapted to house cores with a residence length $L_1$ of, for example, approximately 30 inches, rotor assembly 2 is explained in further detail. Rotor assembly 2 includes an outer rotor housing 5 and a core 6 which is adapted to be disposed within outer rotor housing 5. Outer rotor housing 5 may be made of any material suitable in the centrifugation art, preferably titanium. Core 6 may be made of any material or blend of materials suitable in the centrifugation art, such as, for example, a thermoplastic resin, titanium and polyetheretherketone (PEEK). In a preferred embodiment, core 6 may be formed from a polymeric material such as, for example, a polyphenylene ether, or a blend of more than one polymeric material. A preferred polyphenylene ether is available commercially from the General Electric Company and is sold under the trademark NORYL. Core 6 is substantially cylindrical, but may be configured into any shape that can withstand the stress of centrifugation.

The rotor assembly 2 also includes top end cap 7 and bottom end cap 8. Teflon inserts 9 are adapted to be disposed between outer rotor housing 5 and end caps 7 and 8 to seal the rotor assembly 2. Rotor assembly 2 also includes O-rings 10, 11 and 12 to seal the rotor assembly 2.

Figure 2B:
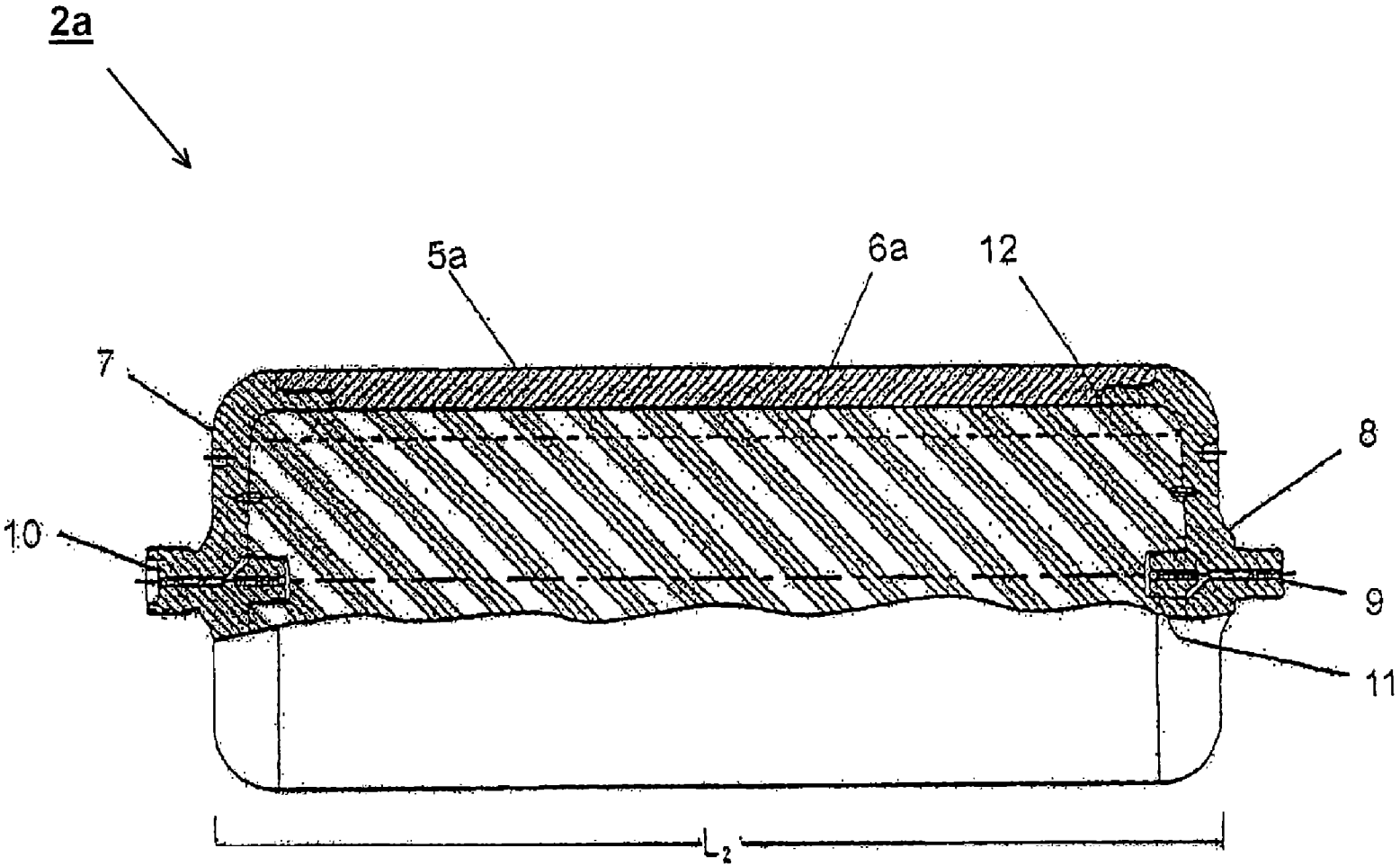
FIG. 2*b* is a front cross-sectional view of a preferred embodiment of a rotor assembly to be rotated in the centrifuge apparatus of FIG. 1.

With reference to FIG. 2*b*, useful for laboratory and/or pilot scale separations and adapted to house cores with a residence length $L_2$ of, for example, approximately 15 inches, rotor assembly 2*a* is explained in further detail. The outer rotor housing 5*a* and the core 6*a* of the rotor assembly 2*a* can be formed of the same materials as the outer rotor housing 5 and core 6 of the rotor assembly 2 of FIG. 2A.

III Description of Core for Use in the Rotor Assemblies

Figure 3A:
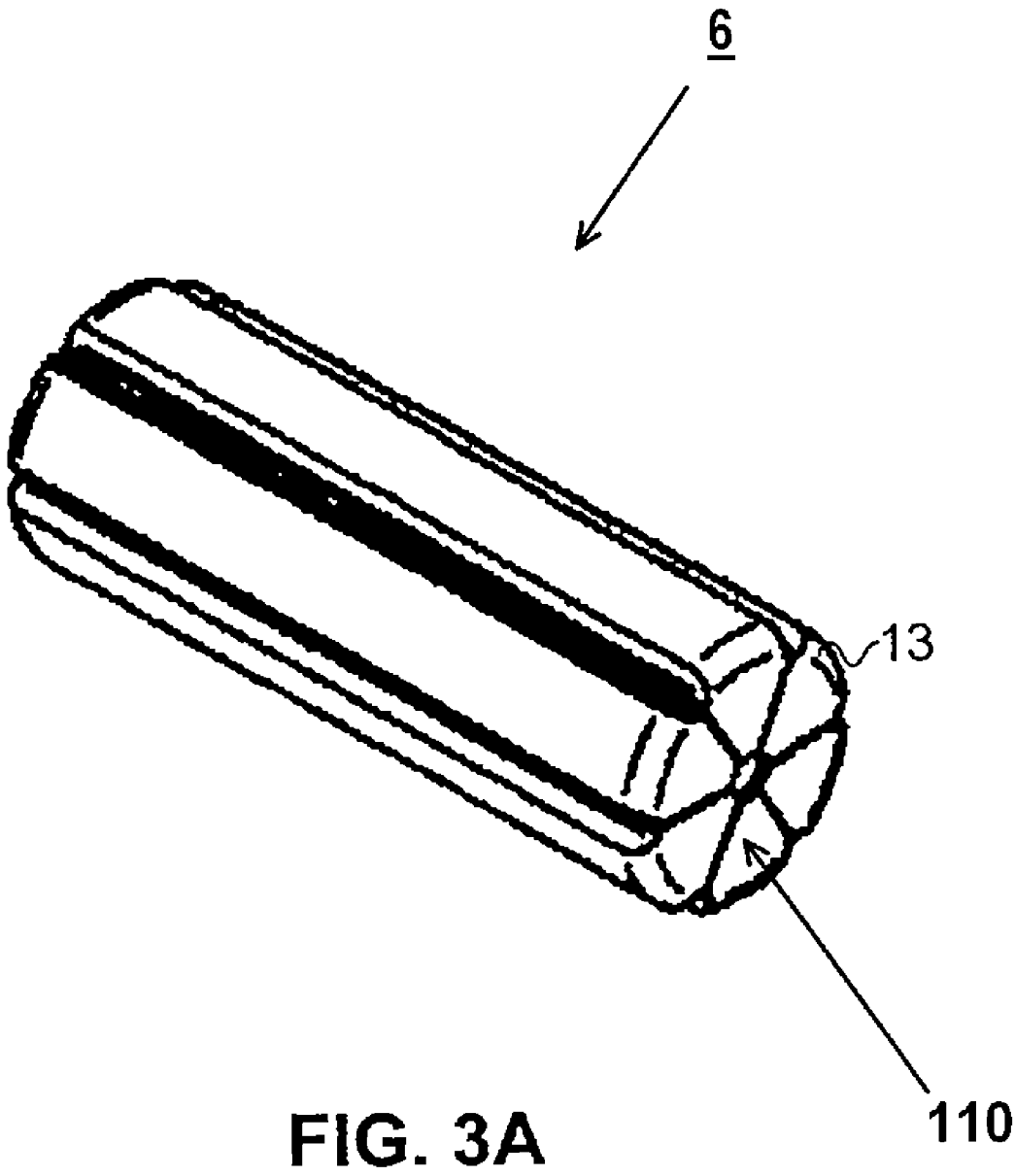
FIG. 3*a* is a front perspective view of a core to be contained within the cylindrical rotor housing of FIG. 2*a*.
Figure 3B:
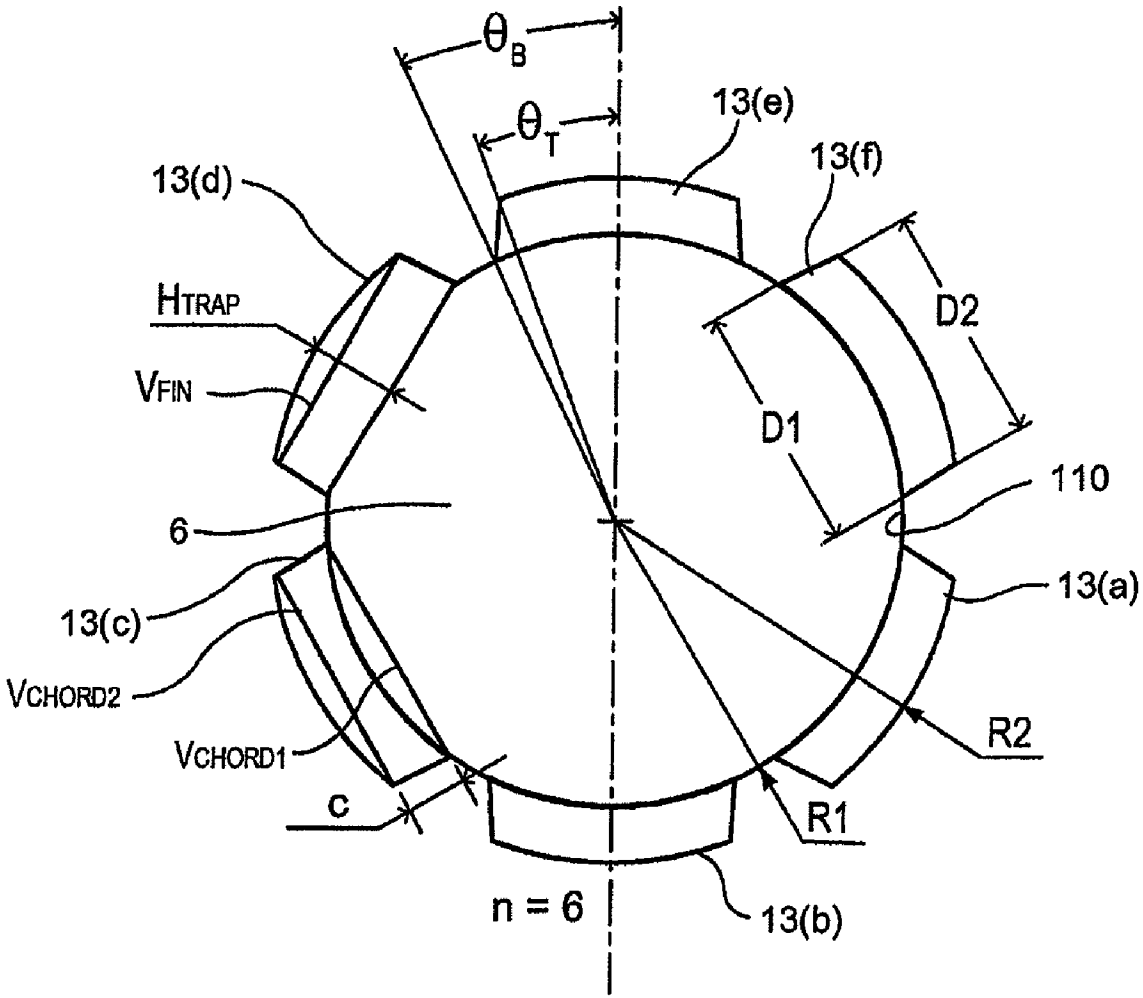
FIG. 3*b* is a side elevational view of a core to be contained within the cylindrical rotor housing of FIG. 2*a*.

Reference is now made to FIGS. 3*a* and 3*b* which are a front perspective view and a side elevational view of core 6 in accordance with the teachings of the present invention wherein the core 6 includes a plurality of fins 13 extending radially outward from the length of the inner cylinder 110 of the core 6. It is contemplated that core 6 typically comprises six fins 13, with these fins being arranged equidistantly from each other. Alternate embodiments may use more or less than six fins, for example from 0 to 36 fins may be employed.

As shown in FIG. 3*b*, core 6 is depicted with six fins 13(*a*)-(*f*) (generally referred to as 13 herein). While six fins are shown in FIG. 3*b*, the core 6 could have more fins or fewer fins depending on the design application. As seen in FIG. 3*b*, R1 represents the distance from center of core 6 to the inner cylinder 110. R2 represents the distance from center of core 6 to the outermost point of fin 13. D1 represents the chord of circle with radius R1. D2 represents the top width of fin 13 and represents a chord of circle with radius R2. As seen in FIG. 3*b*, the dimensions of core 6 which are adjustable include, for example, D2 and R1.

Dimension D2 and D1 are calculated so that the surface of fin 13 facing the fluid to be centrifuged, maintains an angle of typically 2 degrees between the line from center of core to innermost point of the fin 13 and a point on the outermost on fin 13.

To determine the volume available for centrifugation when core 6 is disposed within rotor assembly 2, the volume of liquid typically needs to be calculated. With reference to FIG. 3*b*, the volume of liquid can be calculated as follows:

$$V_{LIQUID}=V_{R2}-V_{CORE}$$

where:

$V_{LIQUID}$ is the volume of the available for fluid during centrifugation.

$V_{R2}$ is the volume of a cylinder with a radius of $R_2$ $V_{CORE}$ is the volume of a core including the core cylinder and fins.

Where $V_{CORE}$ can be determined from:

$$V\text{core}=V_{R1}+nV_{FIN}$$

Where:

$V_{R1}$ is the volume of a cylinder of radius $R_1$ n is the number of fins $V_{FIN}$ is the volume of a single fin defined by dimensions D1, D2, R1, R2 and length of core L.

The volume of the cylinder core 6 with radius R2 (VR2) and the volume of the inner cylinder of core 6 with radius R1 (VR1) are easily determinable using the equations below.

$$VR_2=\pi LR_2^2 \text{ and}$$

$$VR_1=\pi LR_1^2$$

Where:

L is the length of the core.

The value of nVfin is generally calculated as the volume occupied by n number of fins 13. To this end the volume of fin 13 is calculated as the volume of the trapezoid defined by D1, D2, $H_{TRAP}$ of height C minus the volume of $V_{CHORD1}$ defined as volume of the circle segment included in a circle of radius R1 and angle $2\theta_B$ of height C plus the volume of $V_{CHORD2}$ defined as the volume of circle segment included in a circle of radius R2 and angle $2\theta_T$ of height C.

From dimension D2, D1 is calculated so that the surface of fin 13 facing the fluid to be centrifuged maintains an angle of, typically, 2 degrees from vertical. The length of fin 13 is defined by the angle and the two radii (such as, for example, R1=2.143" and R2=2.598").

To determine the volume available for centrifugation when core 6 is disposed within rotor assembly 2, the volume of core 6 typically needs to be calculated. With reference to FIG. 3B, the volume of core 6 can be approximated as follows:

$$V_{CORE}=V_2-V_1-6V_{FIN}$$

where:

$V_2$ is the volume of the outer cylinder of the core (with radius R2), $V_1$ is the volume of the inner cylinder of the core (with radius R1), $V_{FIN}$ is the volume of a single fin of dimensions $\theta_T$, $\theta_B$ and D2, and $V_{CORE}$ is the volume available for fluid during centrifugation.

The volume of the outer cylinder of core 6 with a radius R2 ($V_2$) and the volume of the inner cylinder of core 6 with a radius R1 ($V_1$) are easily determinable. The value of $6V_{VIN}$, however, is generally calculated as the approximate volume occupied by fin 13. To this end, one would consider a section defined by one-half fin 13.

Thus, when the volume of core 6 is determined, the volume of the rotor assembly 2 may be increased and/or decreased depending on the centrifugation protocol required by the user. Such an increase and/or decrease in volume allows the centrifuge to be scaled either up or down for industrial, pilot and laboratory uses, while maintaining substantially the same separation protocols.

Figure 4:
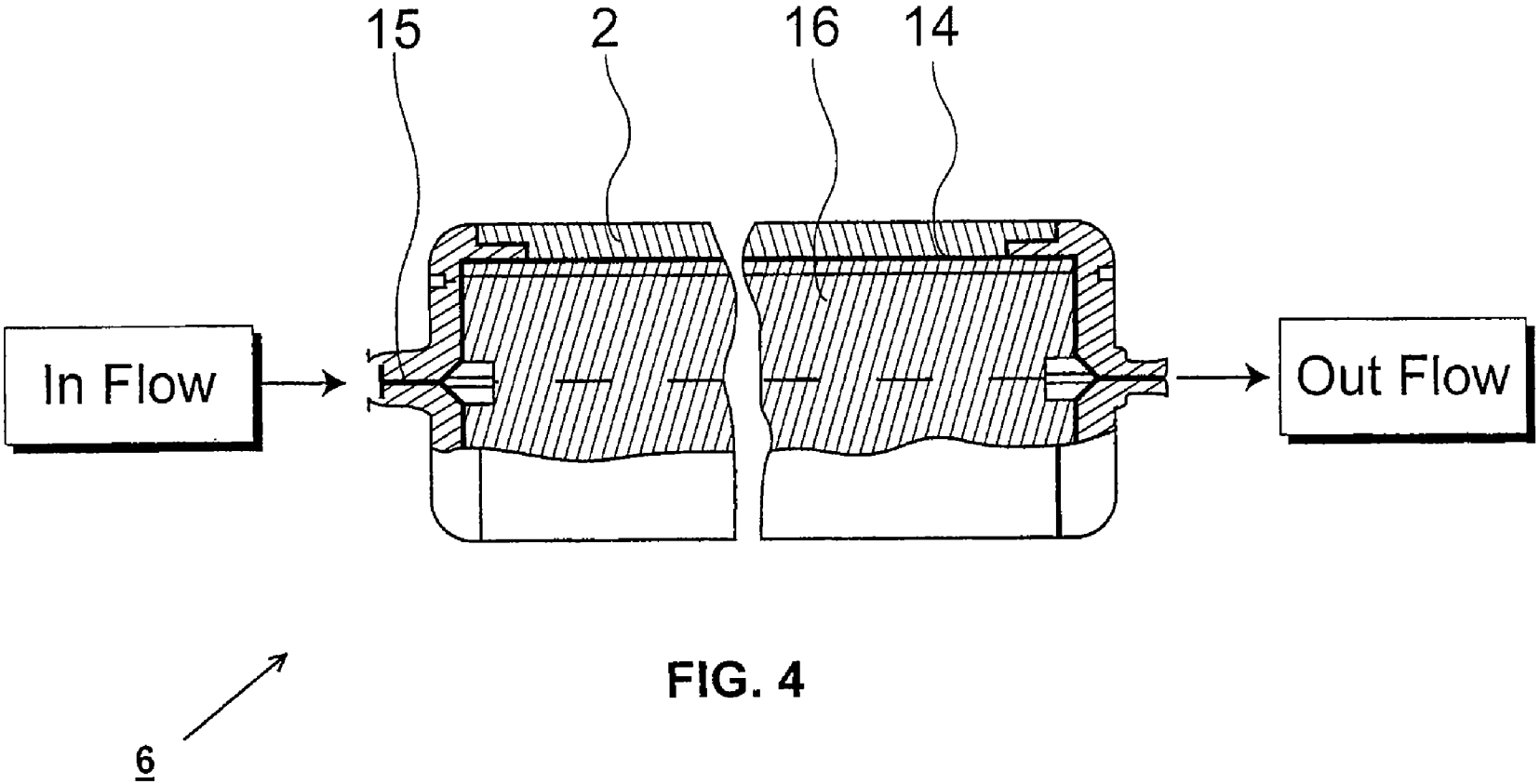
FIG. 4 is a front elevational view of the rotor assembly of FIG. 2*a* illustrating the flow path of product in the rotor assembly.

With reference to FIG. 4, a cross-section of rotor assembly 2 is illustrated wherein flow channel 14 is illustrated. Flow channel 14 provides a path from the center 15 of core 6, in other words, from the point of product entry, to the chambers formed by fins 13. As seen in FIG. 4, the flow path of a product to be separated enters rotor assembly through the center 15 of core 6. The product to be separated then flows through long thin tubular shafts 16 through core 6 and exits the centrifuge for collection.

Figure 5:
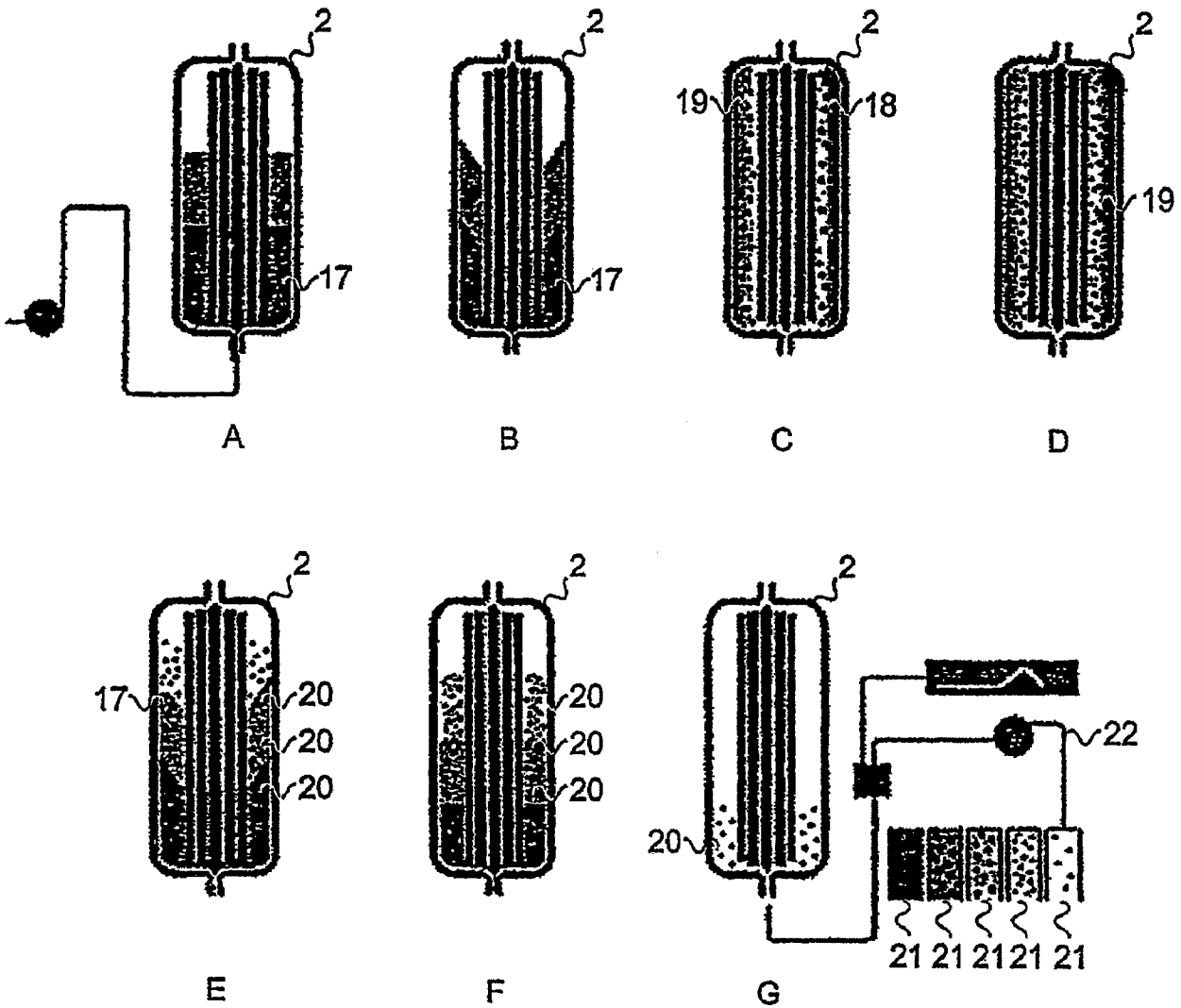
FIG. 5 is a graphic representation of the process steps undertaken in zonal centrifugation utilizing the rotor assembly of FIG. 2*a*.

As shown in FIG. 5, the present invention is useful, for example, for zonal centrifugation. At step A, the density gradient 17 is loaded into the rotor assembly 2 at rest. As the rotor assembly 2 is gradually accelerated, the gradient 17 reorients itself vertically along the walls of rotor assembly 2 as shown in step B. Sample fluid 18 is pumped at step C into rotor assembly 2 at one end on a continuous flow basis. In step C, the sample particles 19 sediment radially into the gradient 17 of increasing density. The sample particles 19 eventually band (isopycnically) in step D in those cylindrical zones where the gradient density equals a particle's buoyant density, commonly referred to iso-dense layers or zones. At the end of the run at step E, rotor assembly 2 is decelerated and the gradient 17 reorients to its original position at step F without disturbing the particle bands 20. The banded particles are now ready to be unloaded with rotor assembly 2 at rest. Fractions 21 are collected using air or water pressure and a small peristaltic pump 22 to control flow at step G. Reorientation is well described in many articles with respect to batch and continuous flow zonal rotors (see, e.g., Anderson, supra, 1967, which is incorporated herein by reference).

In order to provide for a scale separation of reduced volume using the same rotor assembly length, a change in configuration of core 6 to maintain the flow path is necessary. The scale down in volume is achieved by maximizing the size of fin 13 of core 6 to reduce volume radially, while at the same time substantially retaining the essential sedimentation path and residence path of rotor assembly 2.

A further embodiment of the invention contemplates use of computers and software for controlling the centrifuge and calculating the centrifugation protocol. The software-driven control console assembly 4 as seen in FIG. 1 gives the operator all operating parameters displayed in "real-time" on the control screen. Automated programs can also be run from pre-stored files, or manually through the control screen.

During each centrifuge run, on-line data monitoring and recording of set parameters, run parameters, and alarm status are made and are down-loaded to the system memory. Such downloading may also be directed to an external data storage location.

A separation protocol typically involves knowledge of the physical characteristics of the target protein; formation of the gradient; and the calculation of run parameters. The physical characteristics of the target protein useful for defining a separation protocol include, for example, the sedimentation coefficient ($S_{20\omega}$) and buoyant density of the target protein. Such values are useful for reducing the number of trial and error experiments. Otherwise, these can be estimated from preliminary separations performed subsequently.

A separation protocol also typically involves formation of a gradient. The choice of gradient material depends on, for example, the product, impurity stabilities and product densities. Commonly used gradient materials include alkali metals, e.g. cesium chloride, potassium tartrate, and potassium bromide. Although such materials may be corrosive, they create high densities with low viscosity.

CsCl is frequently used as a gradient material and can achieve high density (typically up to approx. 1.9 g/cm$^3$). CsCl, however, can denature certain proteins. CsCl is also costly, may corrode aluminum rotor housings, the steel of the seal assemblies and the rotor assembly shafts. In addition it has been noted that free $Cs^+$ ions are attracted to virus particles. Thus, binding of the virus particle to the toxic metal ion may occur.

Another gradient material is potassium bromide. Although it can reach high densities, it can do so only at elevated temperatures, e.g. 25° C. Such elevated temperatures may be incompatible with the stability of the proteins of interest.

A preferred gradient material is sucrose. It is a cheaper gradient material and utilizes a sufficient density range for most operations (up to approx. 1.3 g/cm$^3$). The viscosity of a sucrose gradient allows for the formation of a step gradient used for banding product, or, alternatively, to create a wide product capacity in the same rotor. The step gradient is the most efficient for continuous flow operation if entry of the non-target protein is to be minimized.

The viscosity of sucrose is a desirable attribute to forming step gradients for long periods of time in a continuous flow rotor. By contrast, a non-viscous solution, e.g. CsCl, may need the addition of a higher-viscosity material, such as glycerol, to increase viscosity and minimize gradient erosion during the run.

The gradient may be loaded either as discontinuous steps or linearly. Loading the gradient as discontinuous steps or as linear gradients allows for the use of a pre-formed gradient, which avoids extended run times to form the gradient. The reduced run time of the separation may be useful for sensitive samples or small particulate proteins, which typically require longer run times to sediment sufficiently.

Loading discontinuous gradients may result in a discontinuous step gradient, which provides for a better separation than a linear gradient. For batch zonal operations performed on a routine basis, the loading of discontinuous step gradients is a simple and highly reproducible technique. A comparison of wide and narrow density gradient formats for continuous flow ultracentrifugation shows that a multi-step gradient forms a shallow gradient with high capacity for product accumulation, whereas a one-step gradient forms a steep gradient minimizing impurities, while maintaining a relatively low capacity.

The shape of the gradient typically depends upon, for example, the internal dynamics of rotor assembly 2. If a reorienting rotor assembly is used, it is readily known that the acceleration and deceleration profiles of the centrifuge should allow for reorientation without disturbing the gradient. Further, the shape of the internal chambers in which the gradient reorients may cause a dispersion of the gradient. If a continuous flow rotor assembly is used, the generated flow can lead to an erosion of the gradient if there is instability in the system; and, upon longer or shorter run times, gradient shape will vary. It has been discovered that using the same centrifuge system is advantageous to scalability.

A separation protocol also typically involves the calculation of run parameters, such as the relative centrifugal force. The relative centrifugal force (RCF) at the chosen speed is calculated by equation (1):

$$RCF(g)=(1.421\times10^{-5})(RPM)^2 d \quad (1)$$

d represents the core diameter (cm)

RPM represents revolutions per minute

This equation determines the force that a particular radius core can produce. All cores of the same radius will typically produce the same g force at the maximum diameter. This is typically relevant to pelleting. In gradient separations, however, there is banding of proteins of interest across the whole core radius which generates a range of g forces. The range of g force created is a function of the cross section path length and, if the inner radius of two rotor assemblies differs, then the separation will differ also between the rotor assemblies. The choice of rotor assembly, therefore, depends on the composition of the product to be separated.

The efficiency of a rotor assembly is expressed as its K factor. The K factor provides an estimate of the time required to band a product at a set rotor assembly speed from an inner radius to a maximum radius. The K factor is usually supplied by the manufacturer of a centrifuge, but can also be determined from equation (2):

$$k=In(r_{max}/r_{min})\times10^{13}/(\omega)^2\,3600 \quad (2)$$

$(\omega)$=0.10472×revolutions per minute (RPM)

$r_{max}$=maximum radial distance from the center of rotation (cm)=

$r_{min}$=minimum radial distance from the center of rotation (cm)

K is a specific value for a rotor assembly at a specific speed. K varies with speed and could be calculated over the full operational speed of the rotor assembly. A low K factor indicates a rotor assembly's greater efficiency.

If the sedimentation path remains constant rotor-to-rotor, then the separation will remain scalable at different volumes. It is known, however, that rotor assemblies in the art differ greatly in the $r_{min}$ $r_{max}$ ranges.

The effect the K factor has on, for example, protein resolution depends on the proteins and the Svedberg Constant. For each protein product, the Svedberg Constant can be determined using equation (3) but is often supplied by references to literature in a particular area of study. The Svedberg Constant is a measure of the rate of movement in a rotor assembly and is usually determined to estimate separations using analytical rotors:

$$S=(1/W^2R\times DR_a/DT)=L_N(R_{max}-R_{min}) \quad (3)$$

$$W^2(T_2-T_1)$$

wherein:

G=Force

D=Diameter In Inches $L_N$=Natural Log

R=Radius $R_a$=Distance From The Axis

T=Time In Hours $T_2$=End Time $T_1$=Start Time

W=Molecular Weight

Once the Svedberg Constant is determined, the theoretical time for a particular rotor assembly is calculated. The theoretical run time T is calculated using equation (4).

$$T=K/S_{20(\omega)} \quad (4)$$

wherein:

T=time (hr)

k=rotor efficiency $S_{20(\omega)}$=sedimentation coefficient

The theoretical runtime T, also known as the "residence time", typically provides for the theoretical minimum run time for a rotor assembly at a specific K factor to ensure completion of product banding. There are other factors which can affect product banding. Such factors include aggregation, particle retention, denaturation, and the interaction with the gradient. Particularly with the use of sucrose, an estimation must be made of the effect of viscosity in the gradient, which varies continuously with increasing density. This is well known and has been tabulated (see McEwen, *Analytical Biochemistry,* 20:114-149, 1967, incorporated herein by reference).

The sedimentation coefficient ($S_{20(\omega)}$) of numerous particulate proteins and macromolecules are known and have been described in the literature. Particulate proteins will tend to fall in the range of small viruses 40S to 1500S If the K factor and the run time of a tubular rotor assembly are known, the run time of the zonal rotor assembly can be determined using equation (5) without the need to calculate $S_{20(\omega)}$:

$$t_1=k_1\times t_2/k_2 \quad (5)$$

wherein:

$k_2$=Efficiency of Rotor Assembly A $t_2$=Run time of Rotor Assembly A $k_1$=Efficiency of Rotor Assembly B $t_1$=Run time of Rotor Assembly B Typically, the protocol used at small scale and the preparative protocol to be derived thereon would use different speeds to run the separation. In order to determine the K factor at a different speed and, therefore, the time to sediment, equation (6) is used:

$$K_{new}=k\,(Q_{max}/Q_{new})^2 \quad (6)$$

wherein:

$Q_{max}$ is the rotor maximum speed (rpm).

$Q_{new}$ is the new rotor speed (rpm).

The present invention may also be used, for example, to pellet the target protein to the wall of rotor assembly 2; to sediment into a dense liquid; or to band in a gradient. Pelleting for example is suitable for extremely robust particles or cells. Sedimenting, for example, allows for recovery of the target protein with minimal loses due to denaturation. Banding in a gradient, for example, allows for removal of impurities.

The present invention may also be used for, for example, isopycnic banding and rate zonal processes. Such processes may be used separately or may be combined to separate, for example, large heavy particles from the usually smaller impurities.

IV. Preferred Embodiments of the Core for Large Scale Production (FIGS. 6 to 9)

FIGS. 6 through 9 are representative cores in accordance with the present invention which are designed for use in large-scale production. Each of the cores 6*b*, 6*c* and 6*f* of the respective cores assemblies of FIGS. 6 through 9 are preferably made of NORYL™, but a skilled artisan would readily appreciate that any material suitable for centrifugation may be used to manufacture the core.

Figure 6:
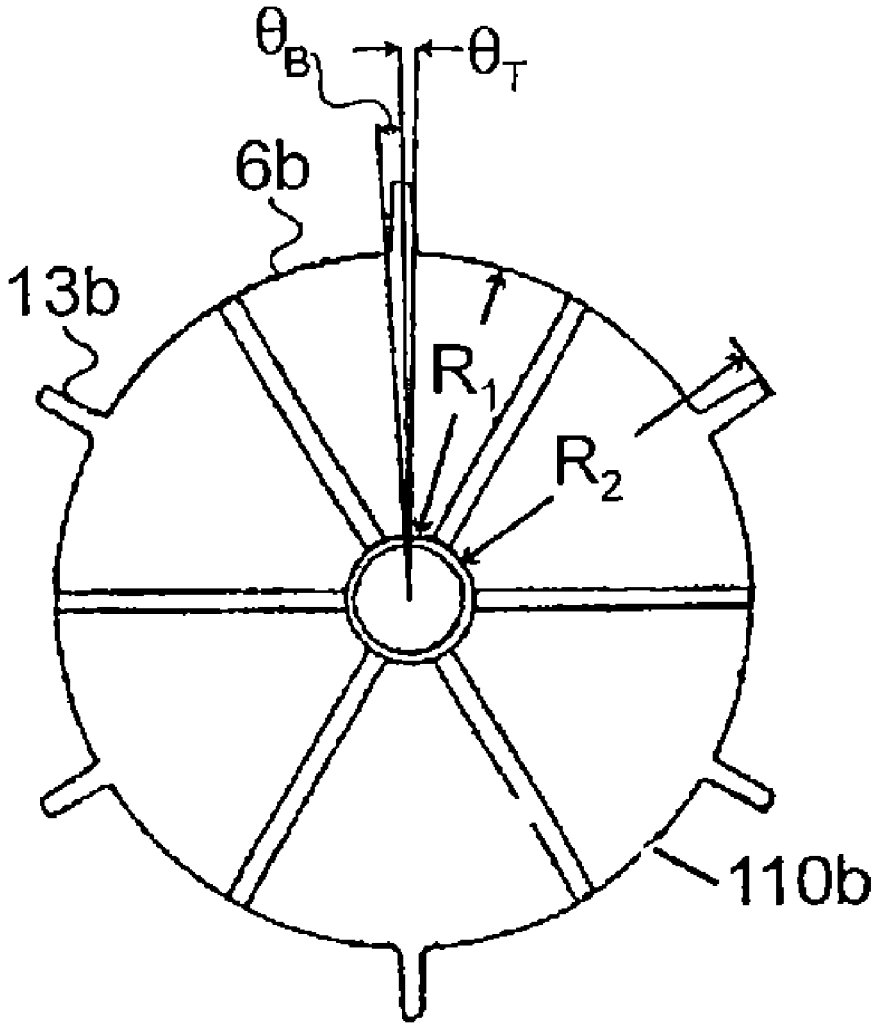
FIG. 6 is a side elevational view of another preferred embodiment of a core to be contained within the rotor housing of the rotor assembly of FIG. 2*a* to be used in large scale volume centrifugation applications.

In the embodiment shown in FIG. 6, core 6*b* includes six fins 13*b* equidistantly spaced apart and radially extending from inner cylinder 110*b*. The radii R1 and R2 of core 6*b* are approximately equal to 2.145 inches and 2.598 inches, respectively, providing a sedimentation path of approximately equal to 0.453 inches (i.e., R2 minus R1). The length of core 6*b* is approximately 30 inches and the chords D1 and D2 of core 6*b* are approximately equal to 0.114 inches and 0.083 inches, respectively. Thus, the volume available for centrifugation is approximately 3.2 liters.

Figure 7:
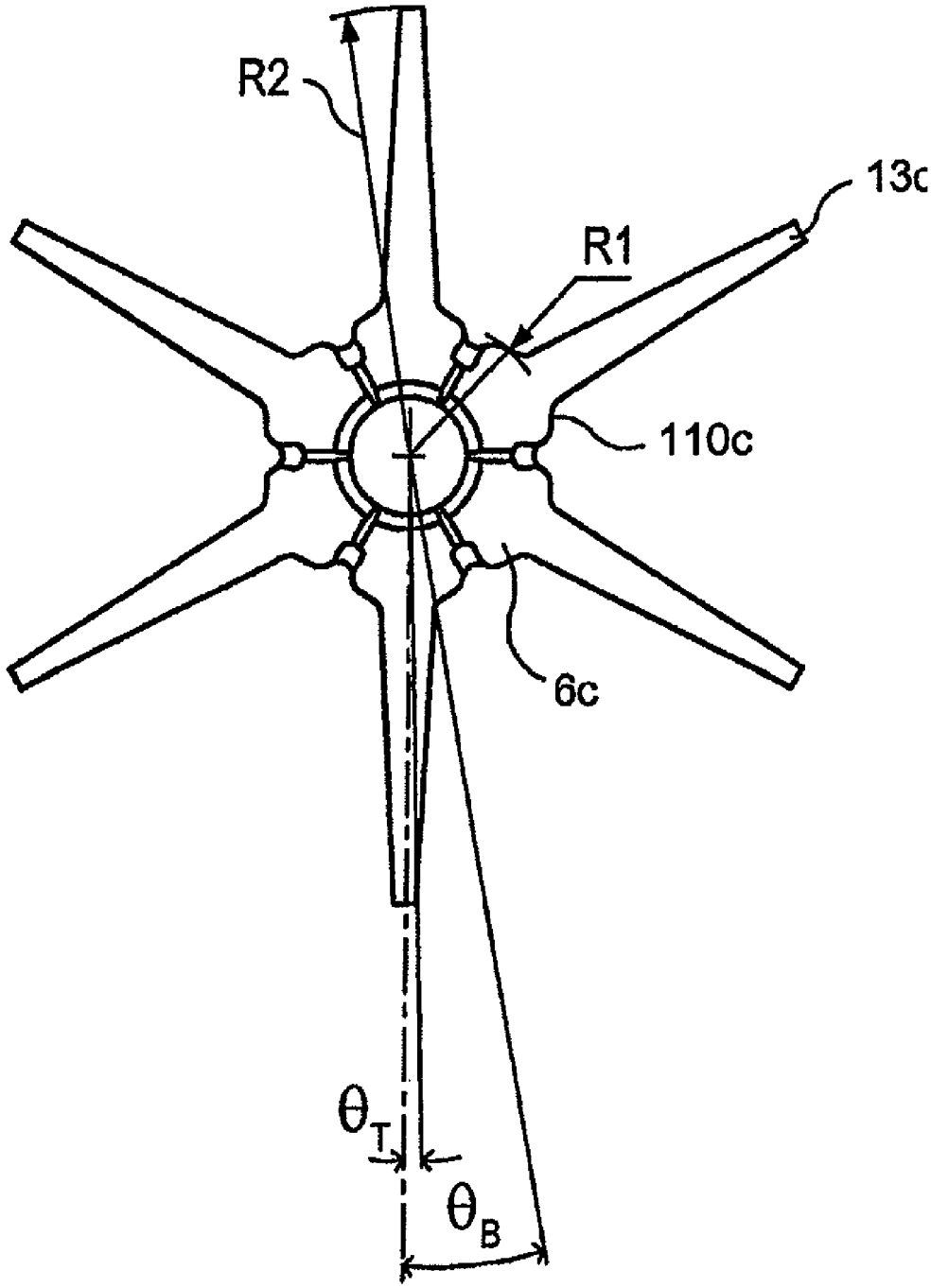
FIG. 7 is a side elevational view of a preferred embodiment of a core to be contained within the rotor housing of the rotor assembly of FIG. 2*a* to be used in large scale volume centrifugation applications.

With reference to another preferred core configuration in FIG. 7, core 6*c* includes six fins 13*c* equidistantly spaced apart and radially extend from the inner cylinder 110*c*. The radii R1 and R2 of the core 6*c* are approximately 0.825 inches and 2.598 inches, respectively, providing a sedimentation path of approximately equal to 1.773 inches (i.e. R2 minus R1). The length of core 6*c* is approximately 30 inches. Thus, the volume available for centrifugation equals approximately 8.4 liters.

Figure 8:
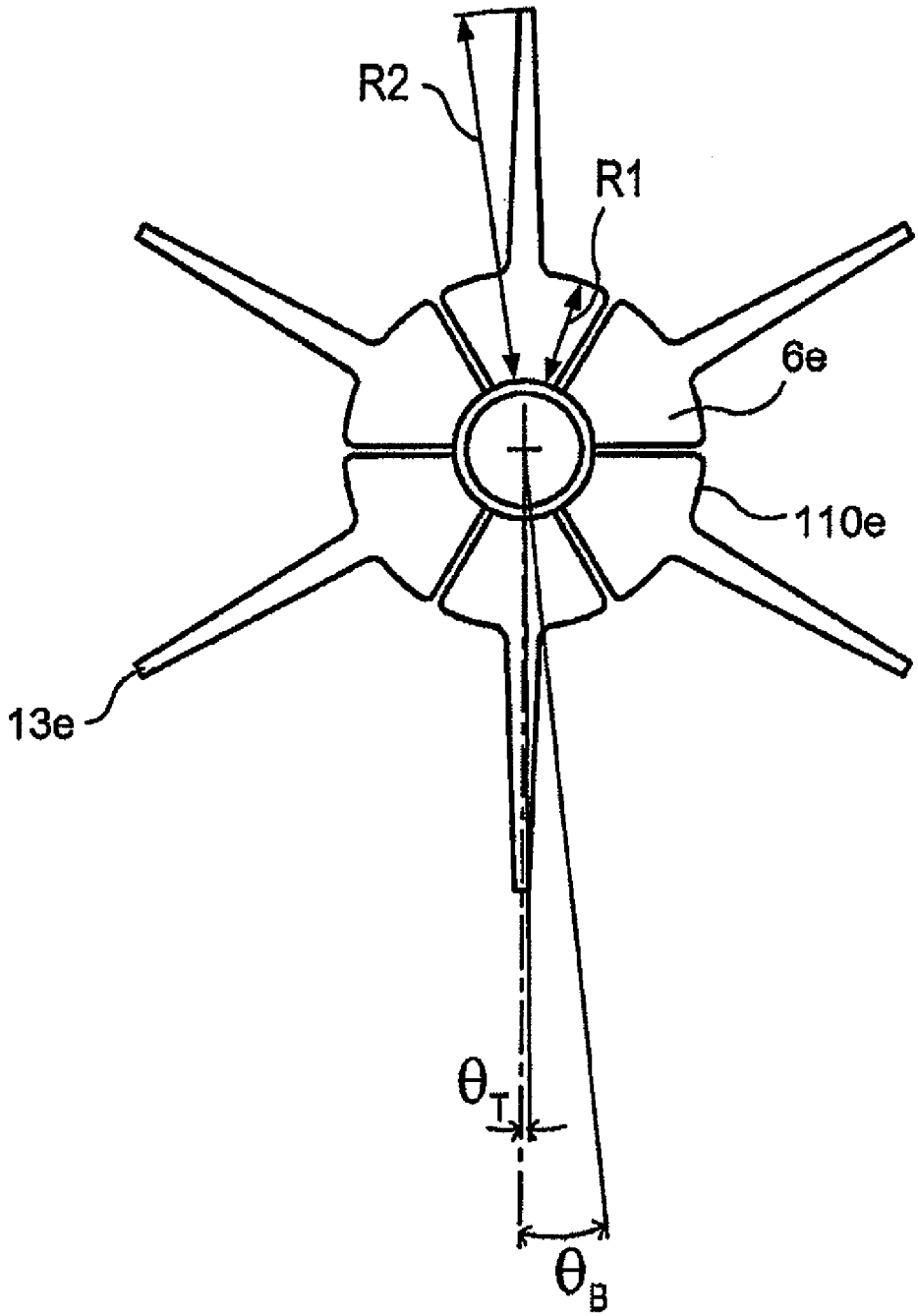
FIG. 8 is a side elevational view of another preferred embodiment of a core to be contained within the rotor housing of the rotor assembly of FIG. 2*a* to be used in large scale volume centrifugation applications.

With reference to another preferred core configuration of FIG. 8, core 6*e* includes six fins 13*e* equidistantly spaced apart and radially extending from the inner cylinder 110*e*. The radii R1 and R2 of the core 6*e* are approximately 1.052 inches and 2.598 inches, respectively, providing a sedimentation path of approximately equal to 1.546 inches (i.e., R2 minus R1). The length of core 6*e* is approximately 30 inches and the chords D1 and D2 of core 6*b* are approximately equal to 0.223 inches and 0.113 inches, respectively. Thus, the volume available for centrifugation equals approximately 8.0 liters.

Figure 9:
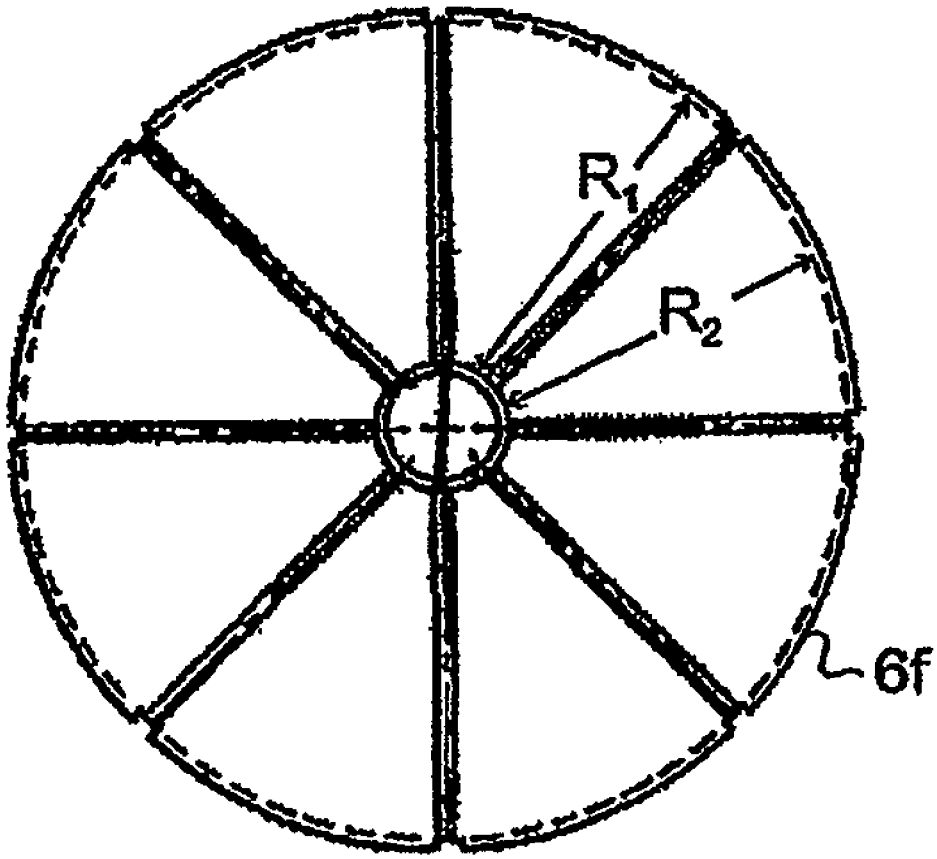
FIG. 9 is a side elevational view of another preferred embodiment of a core assembly to be contained within the rotor housing of the rotor assembly of FIG. 2*a* to be used in large scale volume in centrifugation applications.

With reference to another preferred core configuration of FIG. 9, core 6*f* includes radii R1 and R2 approximately 2.561 inches and 2.598 inches, respectively, providing a sedimentation path of approximately equal to 0.037 inches (i.e., R2 minus R1). The length of core 6*f* is approximately 30 inches and the chords D1 and D2 of core 6*b* are approximately equal to 0.0 inches and 0.0 inches, respectively. Thus, the volume available for centrifugation equals approximately 0.3 liters.

The above figures demonstrate that, given a core with a fixed length, such as, for example, 30 inches, the volume available for centrifugation may be altered by manipulating the dimensions and, thereby, the volume of fins 13 of the core. As will be demonstrated below, formation of equivalent gradients among the large-scale and pilot scale rotor assemblies; equivalent product separation at the iso-dense layer in each scale of rotor assembly; and equivalent product peak shape in the gradient for each scale rotor assembly indicate that scalability and linearity are achieved.

V. Preferred Embodiments of the Core For Small-Scale Production (FIGS. 10 to 13)

FIGS. 10 to 13 are representative cores in accordance with the present invention which are designed for use in small-scale, e.g., pilot and laboratory scale, production.

Each of the cores 6*g-j* of the respective cores of FIGS. 10 to 13 are preferably made of NORYL™, but a skilled artisan would readily appreciate that any material suitable for centrifugation may be used to manufacture the core.

Figure 10:
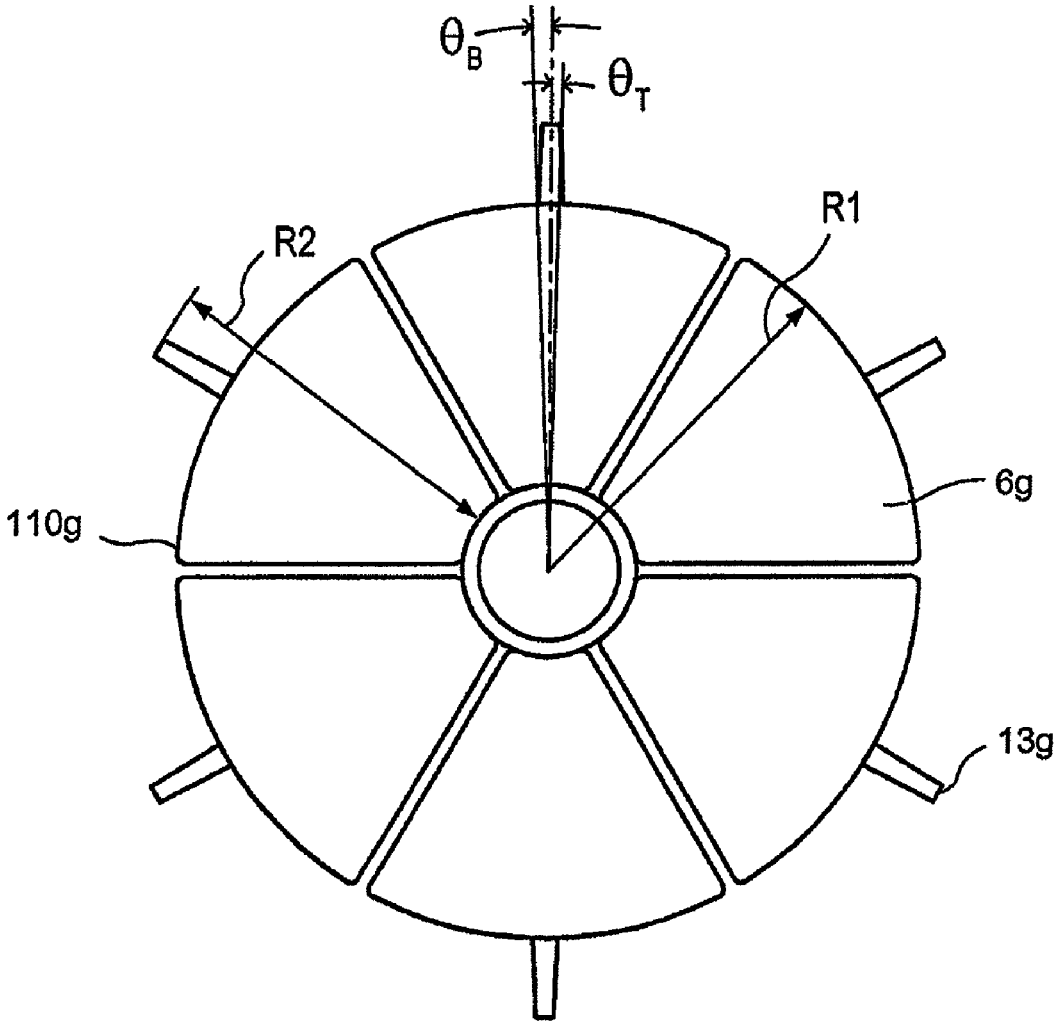
FIG. 10 is a side elevational view of yet another embodiment of a rotor assembly to be rotated in the centrifuge apparatus of FIG. 2*b* to be used in pilot and laboratory scale volume centrifugation applications.

In the embodiment shown in FIG. 10, core 6*g* includes six fins 13*g* equidistantly spaced apart and radially extending from inner cylinder 110*g*. The radii R1 and R2 of core 6*g* are approximately 2.145 inches and 2.598 inches, respectively, providing a sedimentation path of approximately equal to 0.453 inches (i.e., R2 minus R1). The length of core 6*g* is approximately 15 inches. When the chords D1 and D2 of core 6*g* are approximately equal to 0.114 inches and 0.083 inches, respectively, the volume available for centrifugation equals approximately 1.6 liters. Further, when the chords D1 and D2 of core 6*g* are approximately equal to 1.327 inches and 1.296 inches, respectively, the volume available for centrifugation of core 6*g* of FIG. 16 equals approximately 0.8 liters. Also, when the chords D1 and D2 of core 6*g* are approximately equal to 1.881 inches and 1.850 inches, respectively, the volume available for centrifugation of core 6*g* of FIG. 16 equals approximately 0.4 liters.

Figure 11:
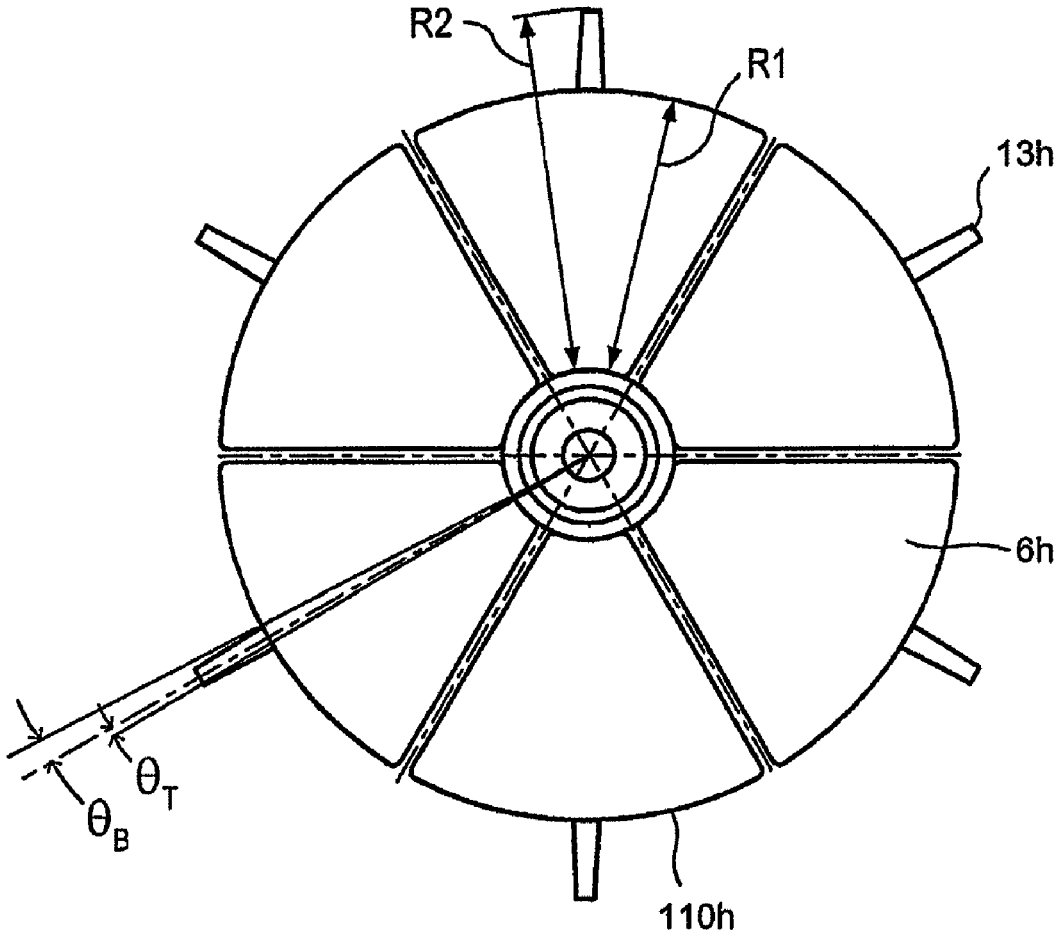
FIG. 11 is a side elevational view of a preferred embodiment of a core assembly to be contained within the rotor housing of FIG. 2*b* to be used in pilot and laboratory scale volume centrifugation applications.

With reference to another preferred core configuration of FIG. 11, core 6*h* includes six fins 13*h* equidistantly spaced apart and radially extending from the inner cylinder 110*h*. The radii R1 and R2 of the core 6*h* are approximately 2.145 inches and 2.598 inches, respectively, providing a sedimentation path of approximately equal to 0.453 inches (i.e., R2 minus R1). The length of core 6*h* is approximately 15 inches. When the chords D1 and D2 of core 6*h* are approximately equal to 0.145 inches and 0.114 inches, respectively, the volume available for centrifugation equals approximately 1.6 liters.

Figure 12:
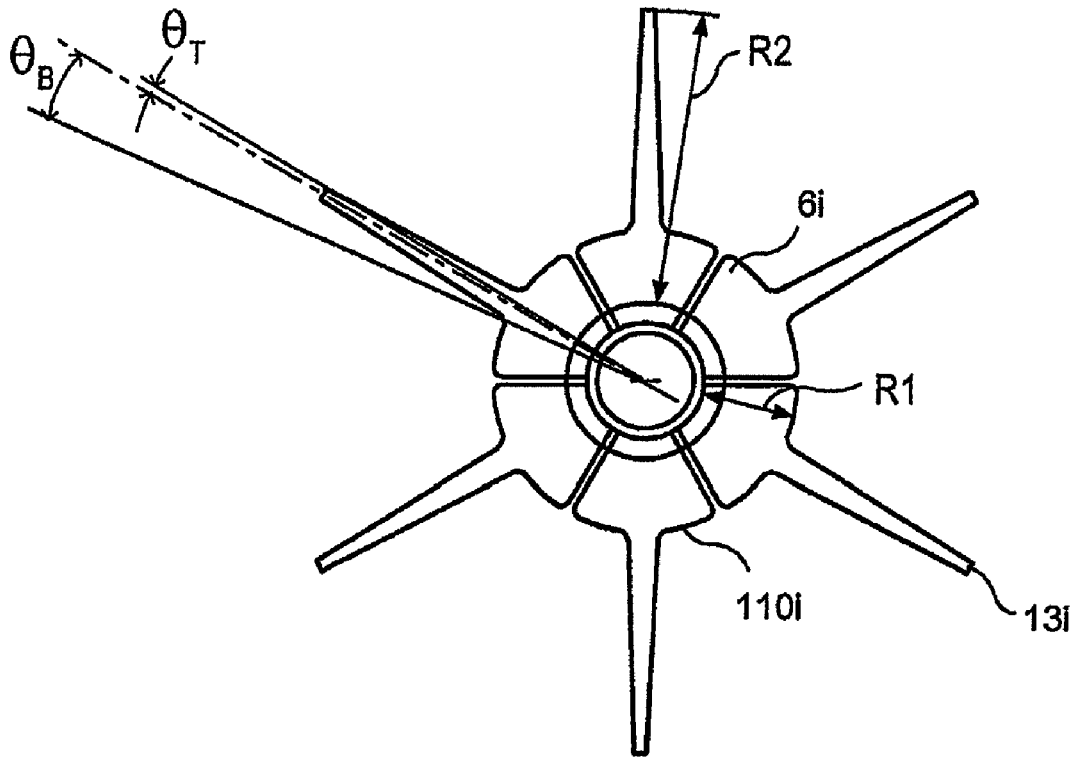
FIG. 12 is a side elevational view of another preferred embodiment of a core assembly to be contained within the rotor housing of FIG. 2*b* to be used in pilot and laboratory scale volume applications.

With reference to another preferred core configuration of FIG. 12, core 6*i* includes six fins 13*i* equidistantly spaced apart and radially extending from the inner cylinder 110*i*. The radii R1 and R2 of the core 6*i* are approximately 1.052 inches and 2.598 inches, respectively, providing a sedimentation path of approximately equal to 1.546 inches (i.e., R2 minus R1). The length of core 6*i* is approximately 15 inches. When the chords D1 and D2 of core 61 are approximately equal to 0.313 inches and 0.113 inches, respectively, the volume available for centrifugation equals approximately 3.9 liters.

Figure 13:
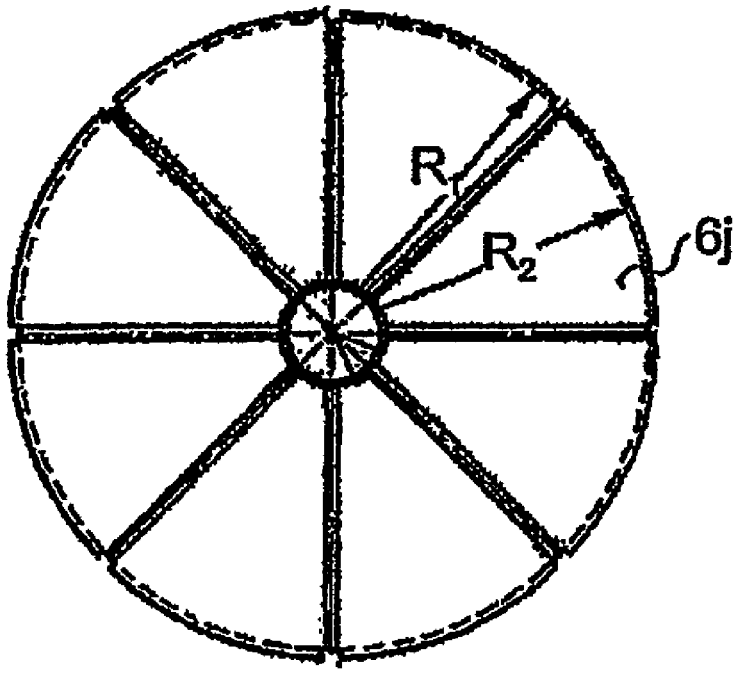
FIG. 13 is a side elevational view of another preferred embodiment of a core assembly to be contained within the rotor housing of FIG. 2*b* to be used in pilot and laboratory scale volume applications.

With reference to another preferred core configuration of FIG. 13, core 6*j* includes radii R1 and R2. The radii R1 and R2 are approximately 2.561 inches and 2.598 inches, respectively, providing a sedimentation path of approximately equal to 0.037 inches (i.e., R2 minus R1). The length of core 6*j* is approximately 15 inches. When the chords D1 and D2 of core 6*j* are approximately equal to 0.0 inches and 0.0 inches, respectively, the volume available for centrifugation equals approximately 0.1 liters.

The above figures demonstrate that, given a core with a fixed length, such as, for example, 15 inches, the volume available for centrifugation may be altered by manipulating the dimensions and, thereby, the volume of fins 13.

DETAILED EXAMPLES

The following examples are set forth to illustrate examples of embodiments in accordance with the invention, it is by no way limiting nor do these examples impose a limitation on the present invention.

The following examples demonstrate that scalability and linearity are achieved using the embodiments of the invention while maintaining the sedimentation path, residence path, and flow dynamics. In particular, the following examples demonstrate, for example, that a centrifuge apparatus operable at certain predetermined parameters depending upon a product to be separated and useable with a plurality of rotor assemblies wherein a first rotor assembly of said plurality of rotor assemblies includes a first core having a first core configuration which is contained within a rotor housing of the first rotor assembly to define a first volume capacity such that the product passing through the first rotor assembly having the first volume capacity during rotation of the first rotor assembly in the centrifuge apparatus achieves a first particle separation of the product, and a second rotor assembly of said plurality of rotor assemblies includes a second core having a second core configuration which is contained with a rotor housing of the second rotor assembly to define a second volume capacity such that product passing through the second rotor assembly having the second volume capacity during rotation of the second rotor assembly in the centrifuge apparatus achieves a second particle separation of the product which is a linear change with respect to the first particle separation.

Further, the following examples demonstrate that scalability and linearity are achieved because, for example, formation of equivalent gradients among the large-scale and pilot scale rotor assemblies was observed; equivalent product separation at the iso-dense layer in each scale of rotor assembly was observed; and equivalent product peak shape in the gradient for each scale rotor assembly was observed. In other words, scalability and linearity are achieved by, for example, operating a centrifuge apparatus at certain predetermined parameters depending upon a product to be separated; placing a first core having a first core configuration in a rotor housing to define a first rotor assembly having a first volume capacity; rotating the first rotor assembly having the first volume assembly having the first volume capacity in the centrifuge apparatus and passing the product through the first rotor assembly during rotation thereof so as to achieve a first particle separation of the product; substituting a second core having a second core configuration within the rotor housing to define a second rotor assembly having a second volume capacity; and rotating the second rotor assembly having the second volume capacity in the centrifuge apparatus and passing the product through the second rotor assembly during rotation thereof so as to achieve a second particle separation of the product which is a linear change with respect to the first particle separation.

Example 1

Preparation of Sucrose

Sucrose crystals (Life Technologies Inc.) were weighed using a top pan balance (two decimal places accuracy) in aliquots of 100 g. Lab water was heated to 60° C. using a heated stir plate. Temperature was measured using a 0-100° C. thermometer. At 60° C. the sucrose was gradually added to the water.

One or two liter lots of sucrose were made and pooled, and stock solutions of 60% w/w sucrose were made. The sucrose density was checked with a refractometer for each lot to maintain consistency to within 60±2% sucrose.

Example 2

Preparation of Beads

Microsphere beads (Bangs Labs Inc.) were diluted in water at concentrations for spectrophotometric analysis. The analysis would be performed on the gradient fractions collected after separation.

Dilutions were made to give an absorbance peak of 1 AU (absorbance unit) at 280 nm. A scan peak of measurement at approximately 265 nm was chosen for analysis of the beads. This proved to be too concentrated to load to the system and a peak of 0.04 OD 280 nm was used. The UV analyses were run at 265 nm, 280 nm and 320 nm. The 280 nm analysis typically showed less variation due to light sensitivity than the analysis at 265 nm. The 320 nm analysis was used to show any light scattering caused by contaminants. A ratio can be calculated between the three analyses to check for contamination of the product to be analyzed. Dilutions were made using p1000 and p200 Gilson pipettes.

A Perkin Elmer Xpress UV spectrophotometer system was used with 1 cm path, 2 ml volume cuvettes. A double beam was used with a blank lane and a test lane. The system was run for base line against water before starting. A calibration was made using the following calibration values: 60% w/w sucrose, RI 1.4418 @ 20° C., 1.2865 g/cm$^3$ @ 20° C., MWT 342.3, 771.9 mg/ml and 2.255 M. All samples were diluted to 0 to 1 absorbance unit for reading. Dilutions were made with water.

Sucrose concentration was measured using the Atago N-2E (Cole Palmer Instrument Co.) hand held refractometer. To check for linearity before use, a dilution series was made in sucrose.

Example 3

Rotor Assembly and System Setup

The assembly of both the large scale and pilot-scale ultracentrifuges followed similar protocols. Some of the operational procedures differed due to the different control consoles. Seal assemblies and rotor assemblies were cleaned with water. Ethanol spray was used to remove visible particulate matter from all surfaces. The rotor assemblies were loaded to the centrifuge system, connections made, subsystems checked, and system started according to the instruction manuals.

In both the large scale and pilot scale systems, the rotor assembly to be tested was filled with water using a peristaltic pump. In addition, a container with a further 2× rotor volume of water was attached to the pump inlet and re-circulated from the centrifuge top outlet. This allowed for water circulation during the start up phase. In both centrifuge systems, the instruction manuals were followed to perform the following steps: the pump was set to deliver approximately 300 ml/min to the rotor; system was run in manual mode to 10,000 rpm; system was run with buffer from top to bottom and bottom to top at 10,000 rpm to remove any bubbles; and system was run down to 0 rpm with buffer flow continuing in the bottom to top direction.

Example 4

Gradient Loading and System Run

Sucrose solution was loaded from the bottom inlet of the system via a peristaltic pump. The sucrose solution was flushed through the pump to a Tee-piece within 50 cm of the bottom inlet of the rotor. At this point the rotor outlet was diverted to a measuring cylinder appropriate to the volume to be displaced.

The sucrose solution was then introduced into the rotor assembly to fill half the volume of the rotor assembly. The volume loaded was measured as the volume of water displaced from the top of the rotor. When loaded, the rotor bottom inlet was closed, the sucrose flushed from the inlet pump to the Tee-piece line.

In both the large-scale and pilot scale systems, the run was started in an auto ramp mode. This provided a smooth regulated acceleration to allow reorientation of the sucrose gradient without disturbance of the layers of sucrose added while stationary to the rotor.

The speed was set to 3,500 rpm. When this speed was reached, the pump was set to run from top to bottom at the product flow rate (calculated for each run). Once any residual sucrose was displaced, the speed was set to 40,500 rpm. At the maximum speed the product inlet was diverted to the test sample. When the entire test sample was loaded the product pump was diverted to the circulating water.

The test sample was left to band for a minimum 30 minutes with a minimal flow rate. Product flow was stopped and the deceleration with brake applied in the Auto ramp mode. At 0 rpm the product was collected.

Example 5

Product Collection

A product pump was set to remove the volume of liquid from the rotor bottom inlet and dispense to containers. Air was allowed to enter the top inlet of the rotor. The rotor volume was divided into 30 fractions. Fraction collection was made by eye for determination of volume by comparison to two standard solutions placed on either side of the fraction to be collected. Collected product was immediately analyzed for density and absorbance. Fractions were stored at room temperature before disposal.

Example 6

Product Analysis

On collection, product fractions were measured for absorbance at $A_{320}$, $A_{280}$ and $A_{265}$. For samples with greater than 1 AU in the sample, a dilution was made and a second reading taken. The refractive index was measured at room temperature with no dilution to sample. No adjustment was made for temperature in the display of results.

Example 7

Analysis of Data

Data collected was plotted as graphs of density versus absorbance. The slope of the sucrose was determined, as well as the peak $A_{260}$ sucrose density.

Example 8

Rotor Selection

The rotor assemblies tested comprised cores having volumes of 3,200 ml (core 6*b* of FIG. 6), 1,600 ml (core 6*g* of FIG. 10), 800 ml (core 6*g* of FIG. 10), and 400 ml (core 6*g* of FIG. 10). Here, all four cores 6 have a common sedimentation path that is approximately equal to 0.453 inches (i.e., R2 minus R1), but different volumes available for centrifugation as a result of different lengths and different chords lengths D1 and D2. The cores were machined from NORYL™, tested as PS280014 (AWI ISO procedure), and then made into high flow format.

Details of Cores Chosen for Experimentation

| Core | Volume (ml) | $R_{min}$ (cm) | $R_{max}$ (cm) | Max speed × 1000 RPM | Length (cm) | Max flow (ml/min) |
|---|---|---|---|---|---|---|
| Core of Figure 6 | 3200 | 5.5 | 6.6 | 40.5 | 76.2 | 667 |
| Core of Figure 10 | 1600 | 5.5 | 6.6 | 40.5 | 38.1 | 333 |
| Core of Figure 10 | 800 | 5.5 | 6.6 | 40.5 | 38.1 | 333 |
| Core of Figure 10 | 400 | 5.5 | 6.6 | 40.5 | 38.1 | 333 |

Example 9

Calculations and Results

Run parameter calculations were made starting with calculation of the relative centrifuge of force (g):

$$RCF(g)=(1.421\times10^{-5})(RPM)^2\,d=2.3307953\times10^4 d,$$

d—rotor diameter in inches. RPM—speed in revs per minute

Core of FIG. 6: Core (4.289 diameter)=g=99,967.81

Rotor assembly (5.201 diameter)=g=121,224.66.

The K factors, runtimes and flow rates were determined as follows:

Determination of K Factor:

$$K\ \text{Factor}=(2.53\times10^5)L_N(R_{MAX}/R_{MIN})/(RPM/1000)^2$$

For example, the K Factor the core of FIG. 6 running at 40.5 k RPM is calculated as:

$$K=(2.53\times10^5)L_N(2.60/2.14)/1.6402\times10^3$$

$$K=4.92605\times10^4/1.6402\times10^3$$

$$K=29.74$$

Determination of Run Time

FOR a 700S particle in the core depicted in FIG. 6:

K=30

T=K/S (Time required to pellet the virus)

T—30/700=0.043 HRS=2.58 MINS

It is understood that 700 is the approximate sedimentation coefficient of the product. The assembly within which the core of FIG. 6 is housed is 3.2 liters minus the amount of gradient.

Determination of Flow Rates

The flow rates for each separation were calculated for the following cores:

Typical Separation Flow Rates.

| Core | Time to Sediment | Residence Time | Flow Through Volume | Flow Rate |
|---|---|---|---|---|
| FIG. 6 | 2.55 min | 3.4 min | 1600 ml | 28 L/h |
| FIG. 10 at 1600 ml | 2.55 min | 3.4 min | 800 ml | 14 L/h |
| FIG. 10 at 800 ml | 2.55 min | 3.4 min | 400 ml | 7 L/h |
| FIG. 10 at 400 m1 | 2.55 min | 3.4 min | 200 ml | 3.5 L/h |

The flow rate for sedimentation was determined with gradient at 500 ml/min (30 L/hr). The flow transient time (T) was 2.4 min. At 400 ml/min (24 L/hr), the transient time was 3 minutes (sufficient time to pellet the product).

In all runs involving the large-scale and pilot-scale separations, the following parameters were chosen: 60% Sucrose w/w filled to half the rotor volume, run speed 40,500 rpm, flow volume bands for, at a minimum, 30 minutes, typically 45 to 60 minutes, collection and sucrose loading at 25% of product loading flow rate, fractionation into 30 aliquots.

Figure 14:
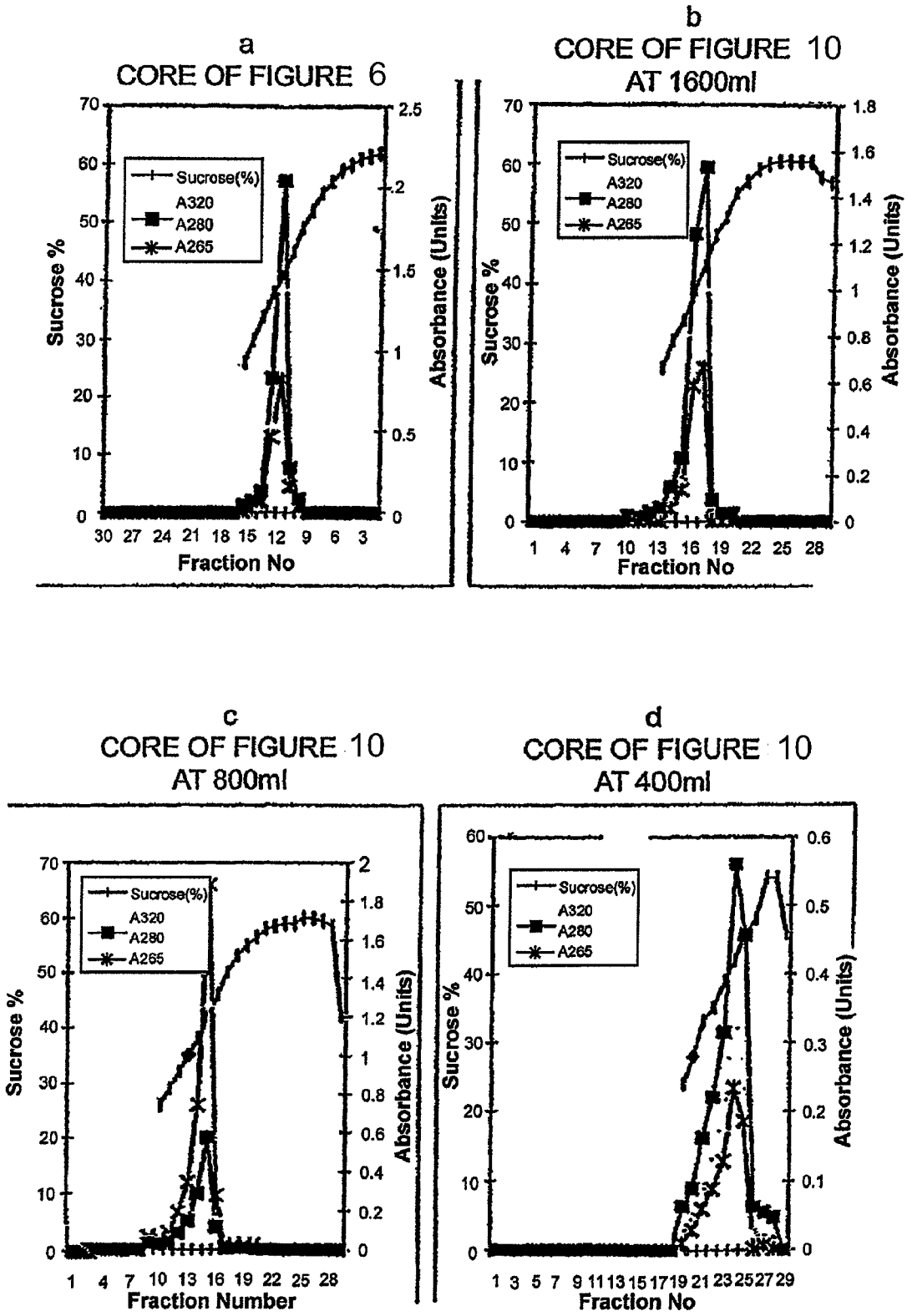
FIGS. 14*a-d* are charts representing the analyses performed on the post banding fractions to measure scalability and linearity of four different core assemblies.

The flow rate for loading and the product collection was determined from the run speed and the product, a dilution of the beads in water (to <0.04 OD $A_{265}$) was made and this volume loaded at maximum speed of the rotor assembly. Post banding, the rotor was run to rest, fractions collected and subsequent analysis of the fractions were plotted as represented in FIG. 14.

FIGS. 14*a-d* illustrate four examples of core configurations. FIGS. 14*a-d* (referred to generally as FIG. 14 herein) illustrate that the banding time was equivalent per run of each of the large-scale and pilot scale centrifuges (45 to 60 min). The duration of the run was approximately 30 mins for the flow through, as the volume of product was approximately 3× the rotor volume. As the data in FIG. 14 indicates, the same separation was obtained for all volume formats for both large-scale and pilot scale systems. Further, a narrow product band at a similar place in the gradient was observed. The narrow peak was a function of the efficiency of separation and the bead size distribution, which is possibly smaller than for a viral particle having degradation products.

In terms of the gradient formed, half the rotor was loaded as density material and the recovery shows half the volume contained gradient. The sucrose loaded as a step has formed a linear format across the rotor. At the maximum density, a sharp cut off was seen. A drop in density was also observed where back mixing occurred due to residual amounts of buffer introduced to the tubing during the continuous flow portion of the run.

Theoretical sedimentation, which was achieved in all cases during the predicted time, was seen to be marginally incomplete as a tail was observed on each product peak.

Analysis of product peaks for each run indicates similar peak height and width in both the large-scale and pilot scale centrifuge systems. The peak density was similar in all centrifuges and any variation was a function of the fractionation pattern by 1 or 2 fractions as seen in the table below.

Peak Analysis for Each Separation

| Core | Peak Recovery @ 25% threshold $A_{280}$ | Peak Recovery @ 25% threshold $A_{280}$ | Peak Fraction (sucrose %) | Peak Density (g/cm$^3$) | Density Range @ 25 % threshold (sucrose %) | Density Range (g/cm$^3$) |
|---|---|---|---|---|---|---|
| Core of Figure 6 | 83% | 82 | 41 | 1.1816 | 38-41 | 1.1663-1.1816 |
| Core of Figure 10 with 1600 ml available | 79 | 86 | 43 | 1.1920 | 39-43 | 1.1713-1.1868 |
| Core of Figure 10 with 800 ml available. | 70 | 70 | 42 | 1.1868 | 38-42 | 1.1663-1.1868 |
| Core of Figure 10 with 400 ml available. | 85 | 94 | 42 | 1.1868 | 33-46 | 1.1415-1.2079 |

All of the preceding confirms, in other words, that linearity and scalability are achieved.

FIG. 14 shows that a similar gradient shape is achievable with the embodiments of the present invention. In other words, from FIG. 14, the present invention achieved both scalability and linearity of the particle separations by, for example, altering the fin dimensions and, thereby, altering the volume of the core. This indicates that the gradient remains identical despite the volumetric difference between each separation. These examples demonstrate, inter alia, that a centrifuge apparatus and process in which the volume of the product sample centrifuged can be scaled up or down while maintaining substantially the same selected separation parameters of the process; that a centrifuge apparatus and process in which the volumetric capacity of the rotor assembly of the centrifuge can be varied or changed to accommodate different volumes of product sample to be centrifuged; and that replaceable cores of different sizes can be utilized in the same centrifuge apparatus to change the volumetric capacity of the rotor assembly to allow scale ups or scale downs of product sample to be centrifuged without substantially altering selected separation parameters such as sedimentation path, residence path and flow dynamics.

Thus, these examples demonstrate that both scalability and linearity are obtainable. Scalability was demonstrated because the run parameters remained substantially the same, even though rotor assembly volume was varied by varying the dimensions of the fins 13. Further, and as shown in FIG. 14, these examples demonstrate that linearity is obtainable because equivalent gradient formation among the large-scale and pilot scale rotor assemblies was achieved; equivalent product separation at the iso-dense layer in each scale of rotor assembly was achieved; and equivalent product peak shape in the gradient for each scale rotor assembly was achieved.

Although preferred embodiments of the present invention and modifications thereof have been described in detail herein, it is to be understood that this invention is not limited to those precise embodiments and modifications, and that other modifications and variations may be affected by one skilled in the art without departing from the spirit and scope of the invention as defined by the appended claims.

What is claimed is:

1. A centrifuge apparatus comprising:

a tank assembly;

a first continuous-flow rotor assembly that comprises a first core having a first core length (L1) that describes a first centrifugation volume and a first sedimentation path, said first continuous-flow rotor assembly being positionable within said tank assembly; and a second continuous-flow rotor assembly that comprises a second core having a second core length (L2) that describes a second centrifugation volume and a second sedimentation path, said second continuous-flow rotor assembly being positionable within said tank assembly, said first centrifugation volume being different than said second centrifugation volume, said first sedimentation path being the same as said second sedimentation path, and said first core length (L1) being the same as said second core length (L2).

2. The centrifuge apparatus of claim 1, wherein said first and second cores each comprise a plurality of fins, each fin of said plurality of fins comprising a surface facing a fluid to be centrifuged, said surface maintaining a predetermined angle from vertical.

3. A centrifuge apparatus comprising:

a tank assembly;

a drive turbine housed within said tank assembly;

a first rotor assembly having a first centrifugation volume and being selectively positionable in said tank assembly so that said drive turbine spins said first rotor assembly; and a second rotor assembly having a second centrifugation volume and being selectively positionable in said tank assembly so that said drive turbine spins said second rotor assembly, said first centrifugation volume being different than said second centrifugation volume, said first rotor assembly comprising a first rotor core having an inner cylinder with a first radius (R1) from a center of said first rotor core, a first core length (L1), and a plurality of fins depending from said inner cylinder with a second radius (R2) from said center such that said first rotor core defines a first sedimentation path, said second rotor assembly comprising a second rotor core having an inner cylinder with said first radius (R1), a second core length (L2), and a plurality of fins depending from said inner cylinder with said second radius (R2) such that said second rotor core defines a second sedimentation path that is substantially the same as said first sedimentation path, said first and second core lengths (L1, L2) being the same.

4. The centrifuge apparatus of claim 3, wherein said plurality of fins depending from said inner cylinder of said first rotor assembly is equal in number to said plurality of fins depending from said inner cylinder of said second rotor assembly.

5. The centrifuge apparatus of claim 3, wherein said plurality of fins depending from said inner cylinder of said first rotor assembly is not equal in number to said plurality of fins depending from said inner cylinder of said second rotor assembly.

6. The centrifuge apparatus of claim 3, wherein each fin of said plurality of fins comprising a surface facing a fluid to be centrifuged, said surface maintaining a predetermined angle from vertical.

* * * * *